US010358876B2

(12) United States Patent
Csergei et al.

(10) Patent No.: US 10,358,876 B2
(45) Date of Patent: Jul. 23, 2019

(54) METHOD AND APPARATUS FOR TRANSPORTING AND STEERING A HEAVY LOAD

(71) Applicant: COLUMBIA TRAILER CO., INC., Hillsboro, OR (US)

(72) Inventors: Steven Andrew Csergei, Hillsboro, OR (US); Ira James Crisp, Portland, OR (US)

(73) Assignee: Columbia Trailer Co., Inc., Hillsboro, OR (US)

( * ) Notice: Subject to any disclaimer, the term of this patent is extended or adjusted under 35 U.S.C. 154(b) by 212 days.

(21) Appl. No.: 15/197,430

(22) Filed: Jun. 29, 2016

(65) Prior Publication Data

US 2017/0022765 A1 Jan. 26, 2017

Related U.S. Application Data

(60) Provisional application No. 62/195,466, filed on Jul. 22, 2015.

(51) Int. Cl.

| | |
|---|---|
| ***B66F 5/00*** | (2006.01) |
| ***E21B 15/00*** | (2006.01) |
| ***B66F 3/24*** | (2006.01) |

(52) U.S. Cl.

CPC ..... *E21B 15/003* (2013.01); *B66F 3/24* (2013.01)

(58) Field of Classification Search

USPC ..... 254/84; 180/8.1, 8.5, 8.6

See application file for complete search history.

(56) References Cited

U.S. PATENT DOCUMENTS

| | | | | |
|---|---|---|---|---|
| 2,914,127 A * | 11/1959 | Ricouard | ..... | B62D 57/00 180/8.5 |
| 3,255,836 A | 6/1966 | Hoppmann et al. | | |
| 3,335,809 A | 8/1967 | Guinot | | |
| 3,576,225 A * | 4/1971 | Chambers | ..... | B65G 7/02 180/8.5 |

(Continued)

FOREIGN PATENT DOCUMENTS

WO WO 2013/109147 7/2013

OTHER PUBLICATIONS

Mobilift TE 95 crane, Paolo de Nicola SpA: Drawings of steering mechanism for model Mobilift TE 95 crane (two pages); Photo of Mobilift Crane (one page); Photo of 95 Metric ton Paolo De Nicola Gantry Crane from http://mediaphotobucket.com/user/Gantrytrader/ (two pages—Visited Apr. 29, 2016).

(Continued)

*Primary Examiner* — Joseph J Hail
*Assistant Examiner* — Shantese L McDonald
(74) *Attorney, Agent, or Firm* — Stoel Rives LLP

(57) ABSTRACT

A method and apparatus for transporting heavy machinery, equipment or other heavy loads from one location to another, whereby the apparatus may be constructed as a walking machine including a plurality of lifting assemblies operative to lift the load above the supporting surface and then move the load relative to the supporting surface by transporting the load via rollers or tracks in the walking machines. In one example, the lifting assemblies are provided with separate longitudinal and lateral drive mechanisms independently operative for translating the load in either or both longitudinal and lateral directions.

13 Claims, 32 Drawing Sheets

(56) References Cited

U.S. PATENT DOCUMENTS

| | | | | |
|---|---|---|---|---|
| 3,680,321 | A | 1/1972 | Bordes | |
| 3,769,802 | A | 11/1973 | Wefer | |
| 3,792,745 | A | 2/1974 | Files | |
| 3,796,276 | A * | 3/1974 | Maeda | B62D 57/00 180/8.5 |
| 3,921,739 | A | 11/1975 | Rich et al. | |
| 4,029,165 | A * | 6/1977 | Miller | B62D 11/20 180/6.48 |
| 4,519,468 | A | 5/1985 | Mick | |
| 5,492,436 | A | 2/1996 | Suksumake | |
| 5,921,336 | A | 7/1999 | Reed | |
| 6,186,480 | B1 | 2/2001 | Leteurtre | |
| 6,234,061 | B1 | 5/2001 | Glasson | |
| 6,240,612 | B1 | 6/2001 | Doll | |
| 6,450,048 | B1 | 9/2002 | Samuelson et al. | |
| 6,467,952 | B2 | 10/2002 | Dernebo | |
| 6,581,525 | B2 | 6/2003 | Smith | |
| 6,581,698 | B1 | 6/2003 | Dirks | |
| 6,659,240 | B2 | 12/2003 | Dernebo | |
| 6,692,185 | B2 | 2/2004 | Colvard | |
| 6,694,861 | B2 | 2/2004 | Glasson | |
| 6,702,600 | B2 | 3/2004 | Glasson | |
| 6,725,761 | B1 | 4/2004 | McNaughton | |
| 6,918,472 | B2 | 7/2005 | Dernebo | |
| 7,059,238 | B2 | 6/2006 | Albright et al. | |
| 7,120,523 | B2 | 10/2006 | Muller | |
| 7,121,185 | B2 | 10/2006 | Alrefai | |
| 7,182,163 | B1 | 2/2007 | Gipson | |
| 7,207,127 | B2 | 4/2007 | Rohr | |
| 7,284,472 | B1 | 10/2007 | Soellner et al. | |
| 7,290,476 | B1 | 11/2007 | Glasson | |
| 7,293,607 | B2 | 11/2007 | Lambert et al. | |
| 7,681,674 | B1 | 3/2010 | Barnes et al. | |
| 7,806,207 | B1 | 10/2010 | Barnes et al. | |
| 7,819,209 | B1 | 10/2010 | Bezner | |
| 8,051,930 | B1 | 11/2011 | Barnes et al. | |
| 8,100,045 | B2 | 1/2012 | Osborn et al. | |
| 8,448,563 | B2 | 5/2013 | Wenker et al. | |
| 8,459,898 | B2 | 6/2013 | Guntert et al. | |
| 8,490,724 | B2 | 7/2013 | Smith et al. | |
| 8,561,733 | B2 | 10/2013 | Smith et al. | |
| 8,573,334 | B2 | 11/2013 | Smith et al. | |
| 8,829,893 | B2 | 9/2014 | Youngner et al. | |
| 9,004,203 | B2 | 4/2015 | Smith et al. | |
| 9,045,178 | B2 | 6/2015 | Smith et al. | |
| 9,096,282 | B2 | 8/2015 | Smith et al. | |
| 9,132,871 | B2 | 9/2015 | Crisp et al. | |
| 2002/0077734 | A1 | 6/2002 | Muller | |
| 2010/0252395 | A1 | 10/2010 | Lehtonen et al. | |
| 2011/0120300 | A1 | 5/2011 | Fletcher et al. | |
| 2014/0054097 | A1 | 2/2014 | Bryant et al. | |
| 2014/0262562 | A1 | 9/2014 | Eldib et al. | |
| 2015/0016887 | A1* | 1/2015 | Schmidt | B63C 1/10 405/3 |
| 2015/0114717 | A1 | 4/2015 | Fortson et al. | |
| 2016/0280524 | A1 | 9/2016 | Crisp et al. | |

OTHER PUBLICATIONS

"New land rig design targets fast-moving shale drilling", Global Energy Services, Drilling Contractor, Mar. 24, 2010, http://www.drillingcontractor.org/new-land-rig-design-targets-fast-moving-shale-drilling-4769 (Visited Jun. 12, 2015).

"Custom Cylinder Solutions for Land-Based Drilling Rigs", Clover Industries, Dec. 21, 2014, http://www.oilgear.com/defaultfilepile/public/clover/documents/clover_land_based_rig_brochure.pdf (Visited Jun. 12, 2015).

Crisp et al., U.S. Appl. No. 15/074,582, filed Mar. 18, 2016.

* cited by examiner

METHOD AND APPARATUS FOR TRANSPORTING AND STEERING A HEAVY LOAD

RELATED APPLICATION DATA

This application claims priority under 35 U.S.C. § 119(e) to U.S. Provisional Application No. 62/195,466, filed on Jul. 22, 2015, hereby incorporated by reference.

BACKGROUND

The field of the present invention is related to a class of transportation machines commonly referred to as "walking machines," which are large, typically non-wheeled power-driven structures operable for transporting massive and heavy loads, upwards of several thousand tons, over a road or other ground surface such as ground, snow, a prepared gravel area, etc. These machines, and the heavy substructures in themselves, are fabricated from steel and other high-strength materials and find particular use in carrying and sequentially transporting large and huge structures such as oil drilling rigs to position, and reposition them, over a drilling well bore in a new field undergoing exploration for oil, or over existing well bores in an old field previously worked, as needed.

Instead of using ground-contacting wheels to move the heavy loads, these walking machines typically comprise a plurality of lifting assemblies that usually use hydraulic lift cylinders to lift the load above the supporting surface and then move the load relative to the supporting surface by transporting the load via rollers or tracks in the walking machines.

In order to position the oil rig or other heavy load in a precise position, these walking machines may be provided with a steering mechanism whereby the walking machine unit may be rotated or steered to a desired position. U.S. Pat. No. 6,581,525, hereby incorporated by reference, shows walking machine systems and methods for moving heavy loads, such as oil rig structures. The U.S. Pat. No. 6,581,525 patent also discloses a steering system for a walking machine in which a substructure of the walking unit may be disengaged and rotated relative to its upper structure thus repositioning the substructure for travel at a desired steered angle. Other steering systems for walking machines are disclosed in U.S. Pat. Nos. 8,573,334 and 7,806,207. The present inventors have recognized that these steering systems have various limitations and potentially undesirable characteristics, which, depending upon the design, may include: only manual repositioning; complicated rotational position detection and control; complicated or unreliable rotational drive mechanisms; excessively high ground pressures and/or limitations on stroke.

SUMMARY

The present invention is directed to apparatus and methods for transporting heavy machinery, equipment or other heavy load from one location to another, whereby the apparatus is constructed to transport the load in multiple directions in order to move the load in a desired path to a set position. A preferred embodiment is directed to a walking machine comprising a plurality of lifting assemblies operative to lift the load above the supporting surface and then move the load relative to the supporting surface (e.g., the road or other ground surface) by transporting the load via rollers or tracks in the walking machines, the lifting assembly including transport mechanisms operative for transporting the load in multiple directions—in one example both a first direction (e.g., longitudinally) and a second direction (e.g., laterally)—so that lifting assemblies may be driven in a desired walking direction or along a desired path.

Additional aspects and advantages will be apparent from the following detailed description of preferred embodiments, which proceeds with reference to the accompanying drawings.

BRIEF DESCRIPTION OF THE DRAWINGS

In FIG. 9 the walking units are in a first longitudinal position and central lateral position; in FIG. 10 the walking units are in a forward extended position and central lateral position; in FIG. 11 the walking units are in the first (rearward) longitudinal position and right side lateral position; in FIG. 12 the walking units are in the first (rearward) longitudinal position and left side lateral position.

FIGS. 36A, 36B and 36C illustrate the walking machine unit of FIG. 14 with the longitudinal drive in the fully retracted position and the lateral drive in the fully retracted position, FIG. 36A being a top plan view, FIG. 36B a front side elevation view, and FIG. 36C a partial cross-sectional view of FIG. 36B taken along lines 36C-36C.

FIG. 42 is a partial cross-sectional view of the walking machine unit of FIG. 14 illustrating a lifting device with the lift mechanism in a second partially extended position, with the foot pad in contact with the ground.

FIG. 43 is a partial cross-sectional view of the walking machine unit of FIG. 14 illustrating a lifting device with the lift mechanism in the fully extended position, in position lifting the load.

DETAILED DESCRIPTION OF PREFERRED EMBODIMENTS

The preferred embodiments will now be described with reference to the drawings. With reference to the above-listed drawings, this section describes particular example embodiments and their detailed construction and operation. To facilitate description, any element numeral representing an element in one figure will be used to represent the same element when used in any other figure. The embodiments described herein are set forth by way of illustration only and not limitation. It should be recognized in light of the teachings herein that there is a range of equivalents to the example embodiments described herein. Notably, other embodiments are possible, variations can be made to the embodiments described herein and there may be equivalents to the components, parts, or steps that make up or augment the described embodiments.

Figure 8:
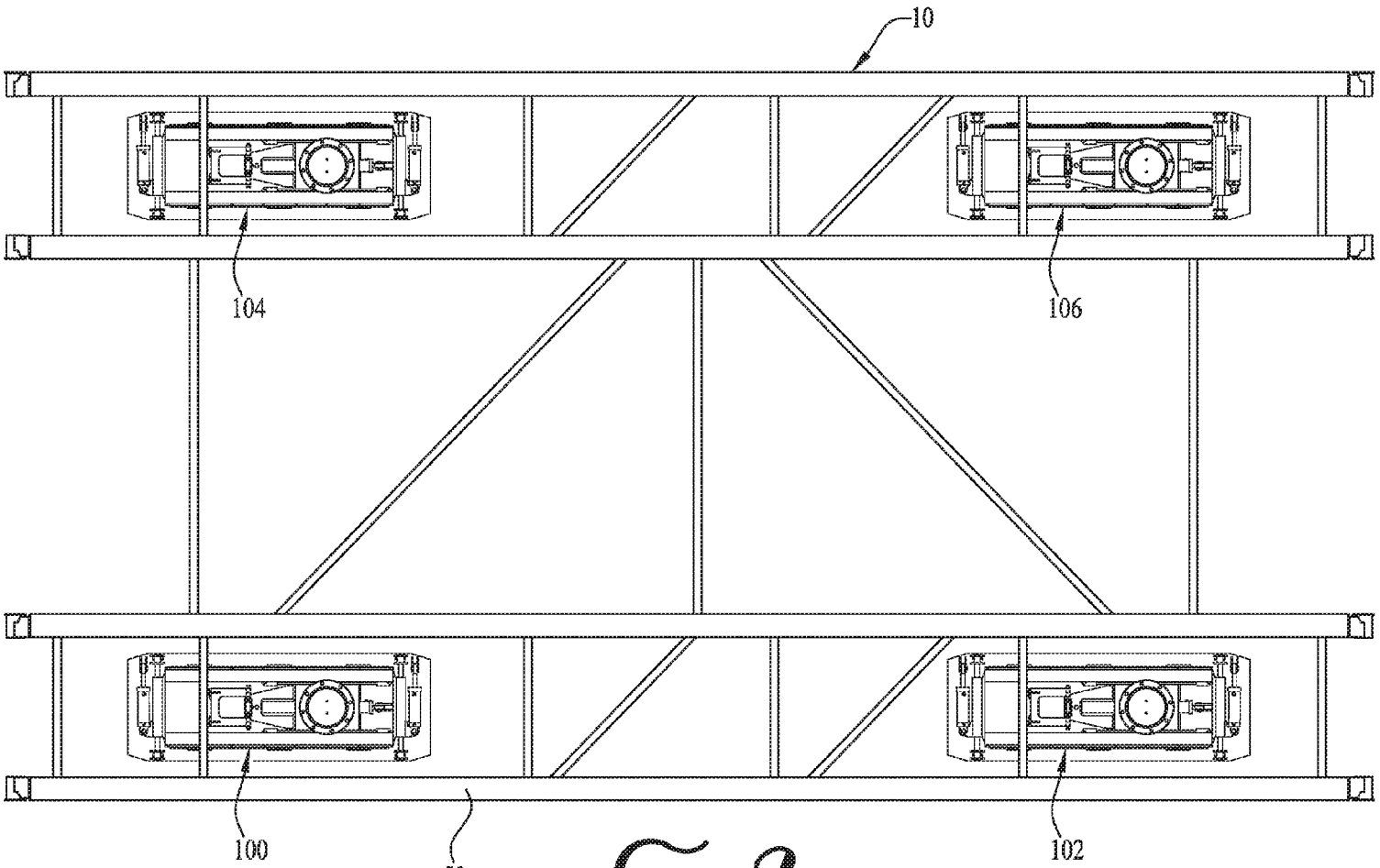
FIG. 8 is a top plan view of a walking machine system according to a preferred embodiment, with four walking machine units, one disposed at each of the four corners of the oil rig.

FIGS. 1-7 are a series of schematic drawings for an example walking machine system for moving a large support structure shown as an oil rig 10 along a ground surface 5. The oil rig 10 is supported onto the ground surface 5 by a plurality of support legs 55 attached to the bottom support structure 50. The walking machine system includes a set of four lifting assemblies (or lifting machine units), with a lifting assembly or unit arranged in position proximate each of the corners of the oil rig 10. Two lifting assemblies 100, 102 are visible in FIGS. 1-7 and the other two lifting assemblies 104, 106 are shown in FIG. 8 described below. The lifting assemblies 100, 102, 104, 106 may be supported via a longitudinal beam (as shown) or other configuration such as via a horizontal beam. Though four lifting assemblies are shown, the system may include additional lifting assemblies.

Figure 1:
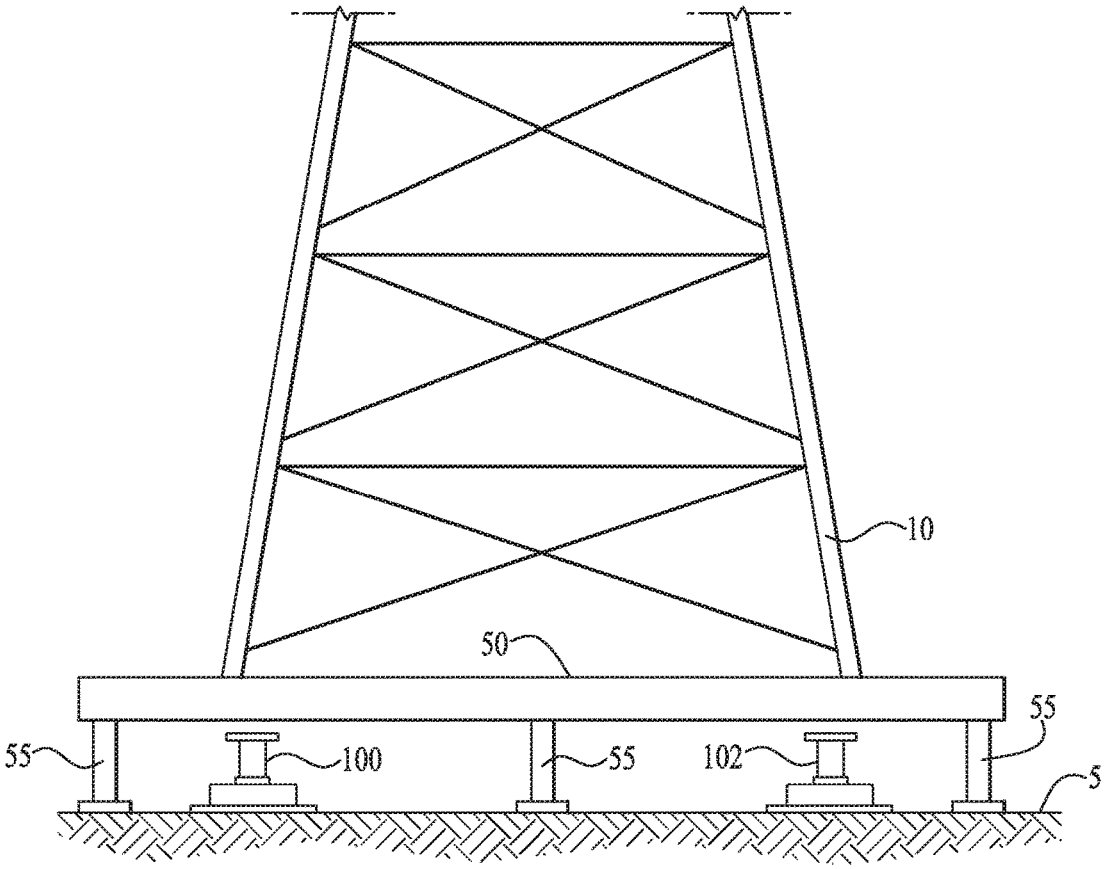
FIG. 1 is a diagrammatic view of an example walking machine system for moving a large support structure shown as an oil rig.
Figure 2:
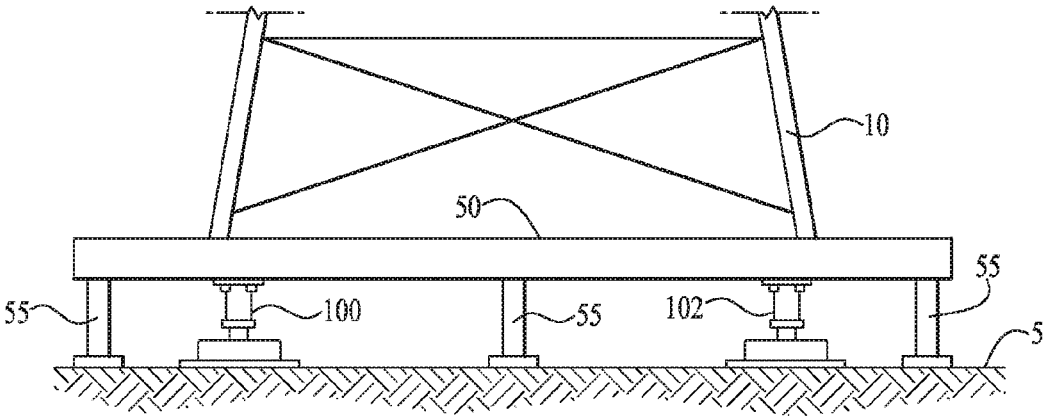
FIG. 2 is a partial view of the walking machine system of FIG. 1 with the walking machine units in position connected to the oil rig.
Figure 3:
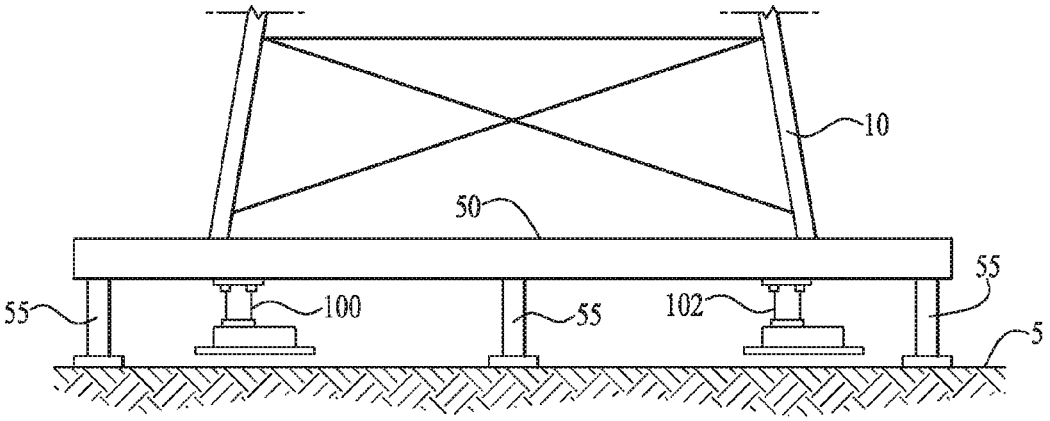
FIGS. 3-7 are partial views of the walking machine system of FIG. 1 illustrating the operation of the walking machine units.
Figure 4:
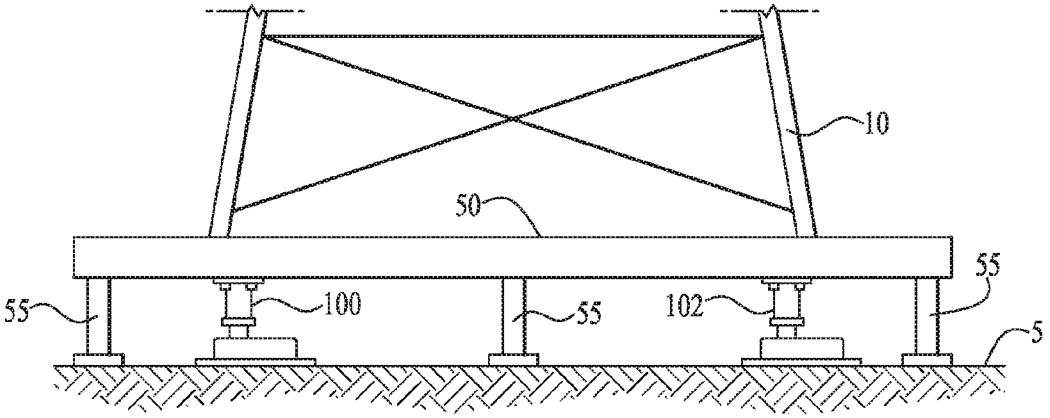
Figure 5:
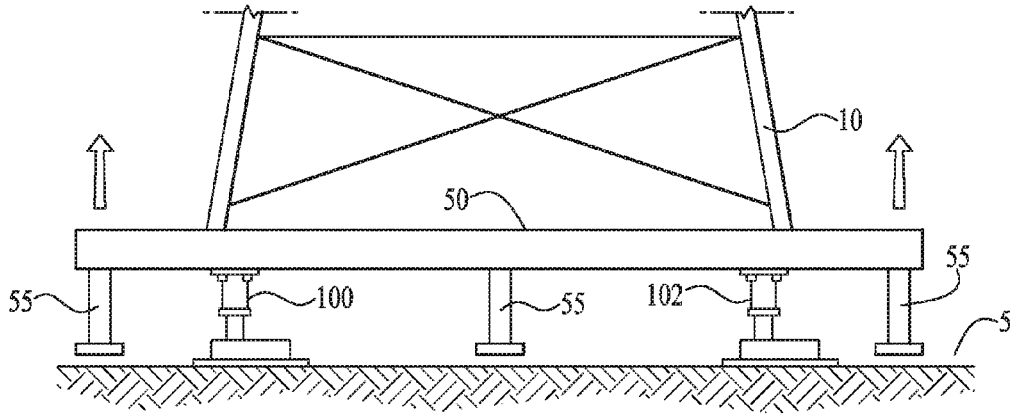
Figure 6:
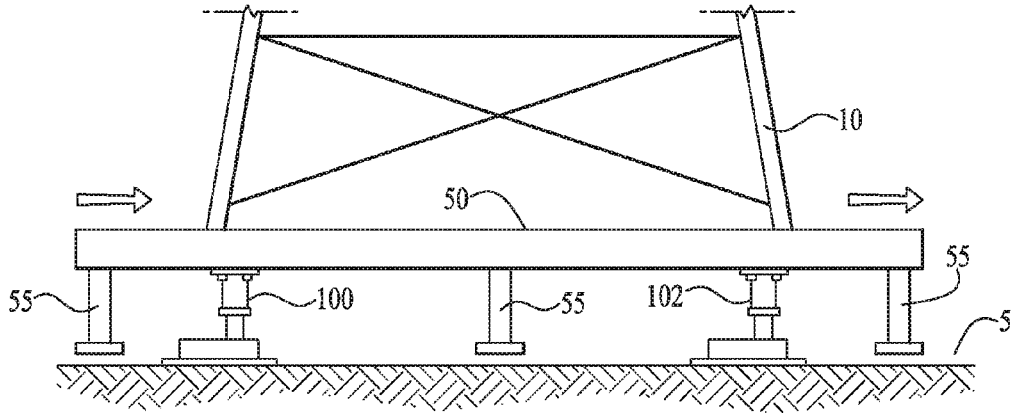
Figure 7:
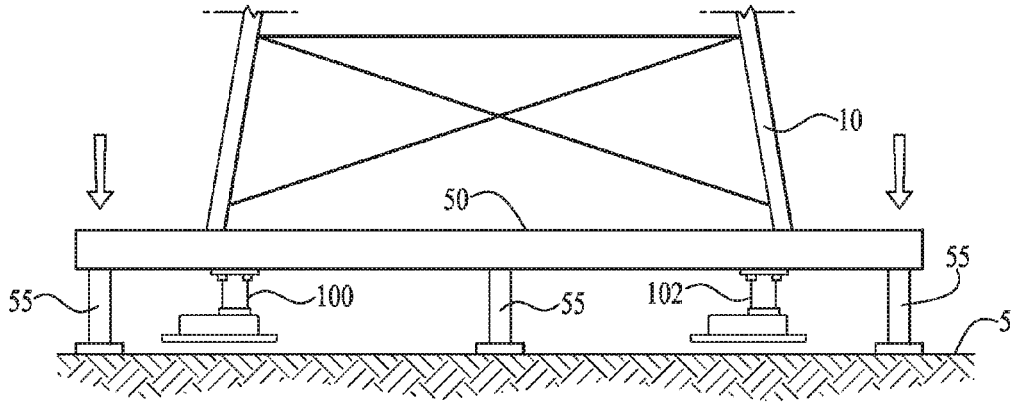

Operation of the lifting assemblies 100-106 is now described with respect to a first lifting assembly 100. For initial installation, the lifting assembly 100 is set in position on the ground as in FIG. 1 with its lifting cylinder retracted. The lifting cylinder is raised partway as in FIG. 2 and contacts the oil rig support beam/structure 50 and is then connected thereto by bolting (the attachment bolts are visible in FIG. 2) or other suitable attachments. The lifting cylinder is then retracted thereby lifting the lower structure or jack pad of the lifting assembly 100 off the ground (due to its attachment to the support beam 50 of the oil rig 10) and then the lifting assembly lower structure and foot pad are driven forward by a first push-pull mechanism to the forward position as in FIG. 3. The lifting cylinder is then partially extended, lowering the lifting assembly lower structure and jack pad to the ground as shown in FIG. 4. The lifting cylinder is then raised to the extended position thereby lifting the support structure 50 and support legs 55 off the ground as in FIG. 5. Once the oil rig 10 is lifted, the lifting assembly lower structure (the foot) is driven rearward by the first push-pull mechanism to the rearward position thereby moving the rig 10 forward as in FIG. 6. The lifting cylinder is then retracted, lifting the assembly lower structure as in FIG. 7, after which the assembly lower structure may then be driven forward to the position as in FIG. 3. The process steps are then repeated.

In one embodiment, a second push-pull mechanism, operating separately or in combination with the first (longitudinal) push-pull mechanism, provides for lateral drive motion. In any event, the second (lateral) push-pull mechanism is operable independently from the first (longitudinal) push-pull mechanism enabling for lateral motion with or without longitudinal motion.

Further details of the lifting assembly and push-pull mechanisms will now be described. FIG. 8 illustrates a top plan view of the walking machine system comprised of the four walking machine units 100, 102, 104, 106 with the rig 10 removed and showing substructure 50. The walking machine units 100-106 in FIG. 8 are illustrated in a first longitudinal (non-extended) travel position, and laterally centered.

Figure 9:
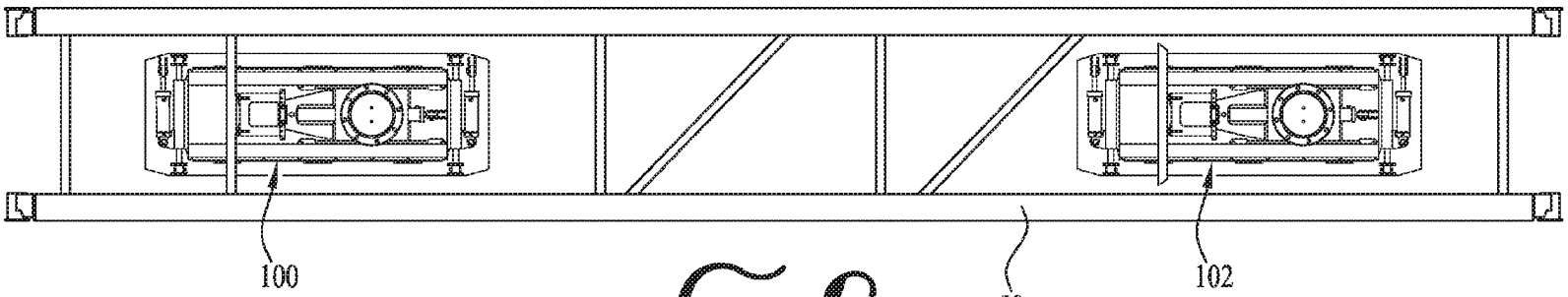
FIGS. 9-12 are each a top plan view of one side of the walking machine system of FIG. 8, illustrating two walking units.
Figure 10:
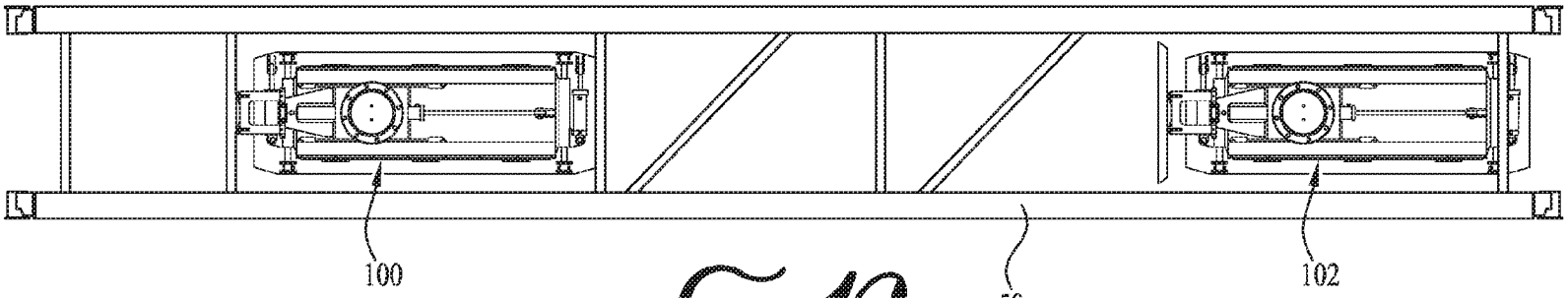
Figure 11:
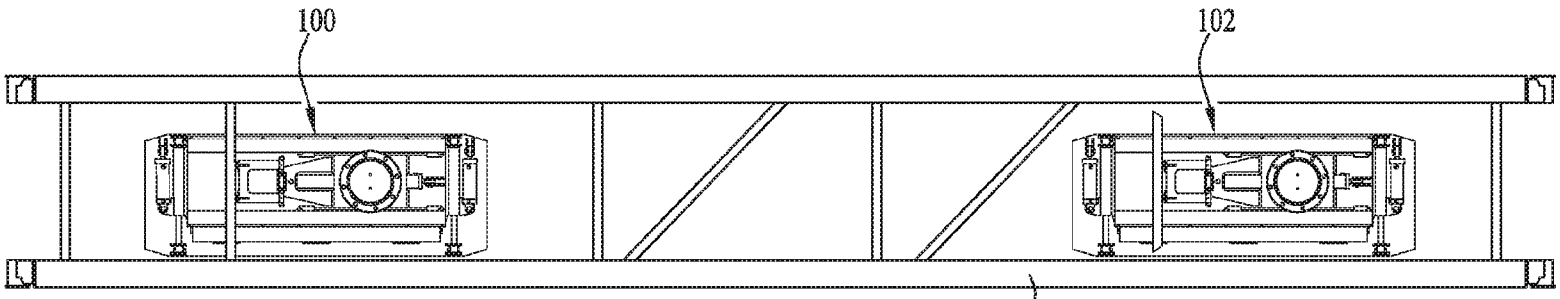
Figure 12:
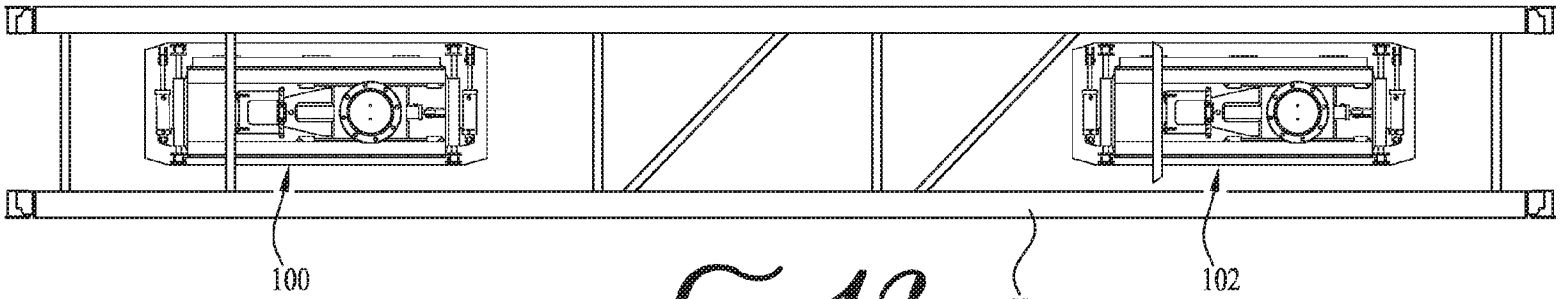
Figure 13:
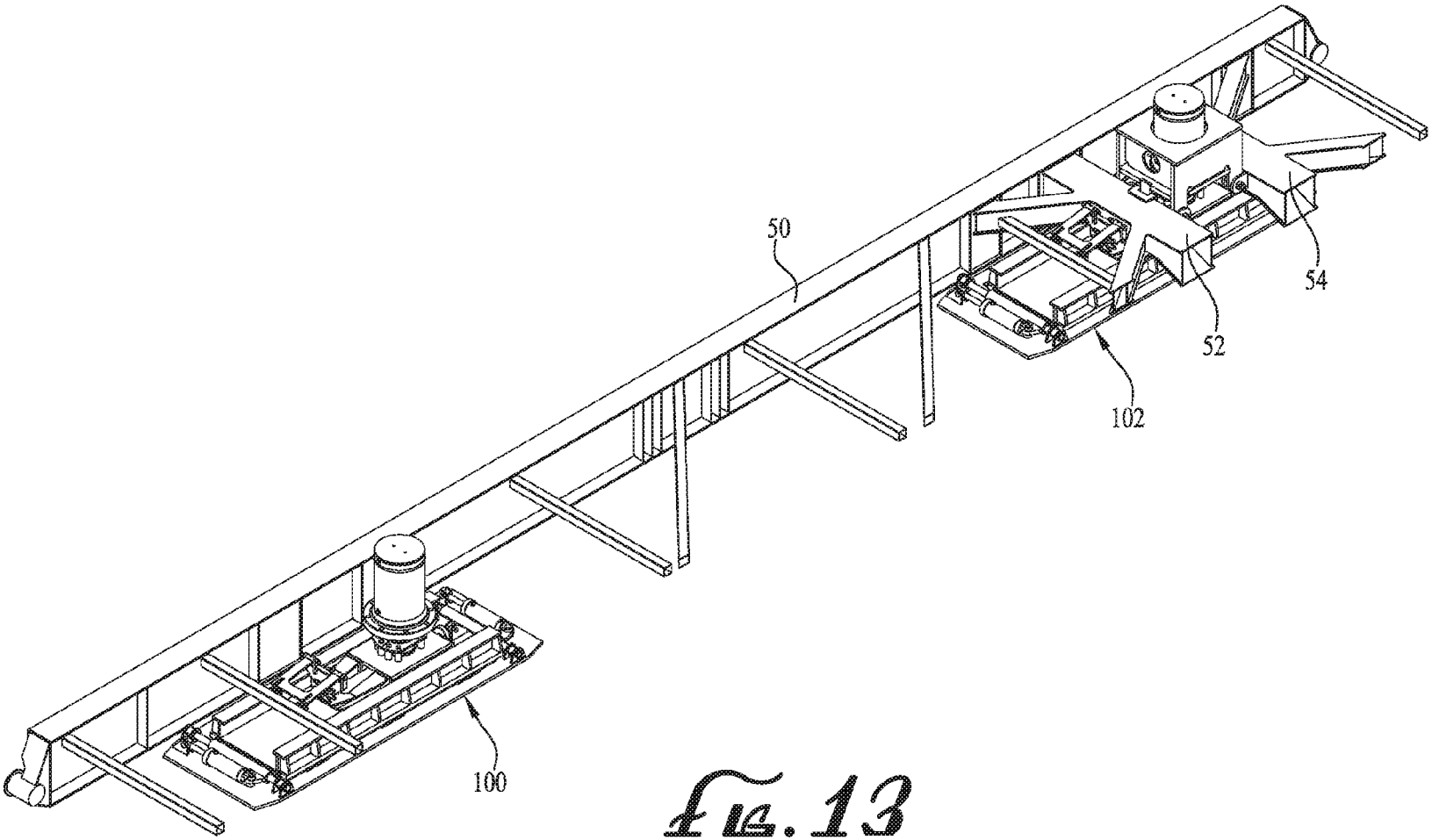
FIG. 13 is a top isometric view of the walking machine units of FIG. 9.
Figure 14:
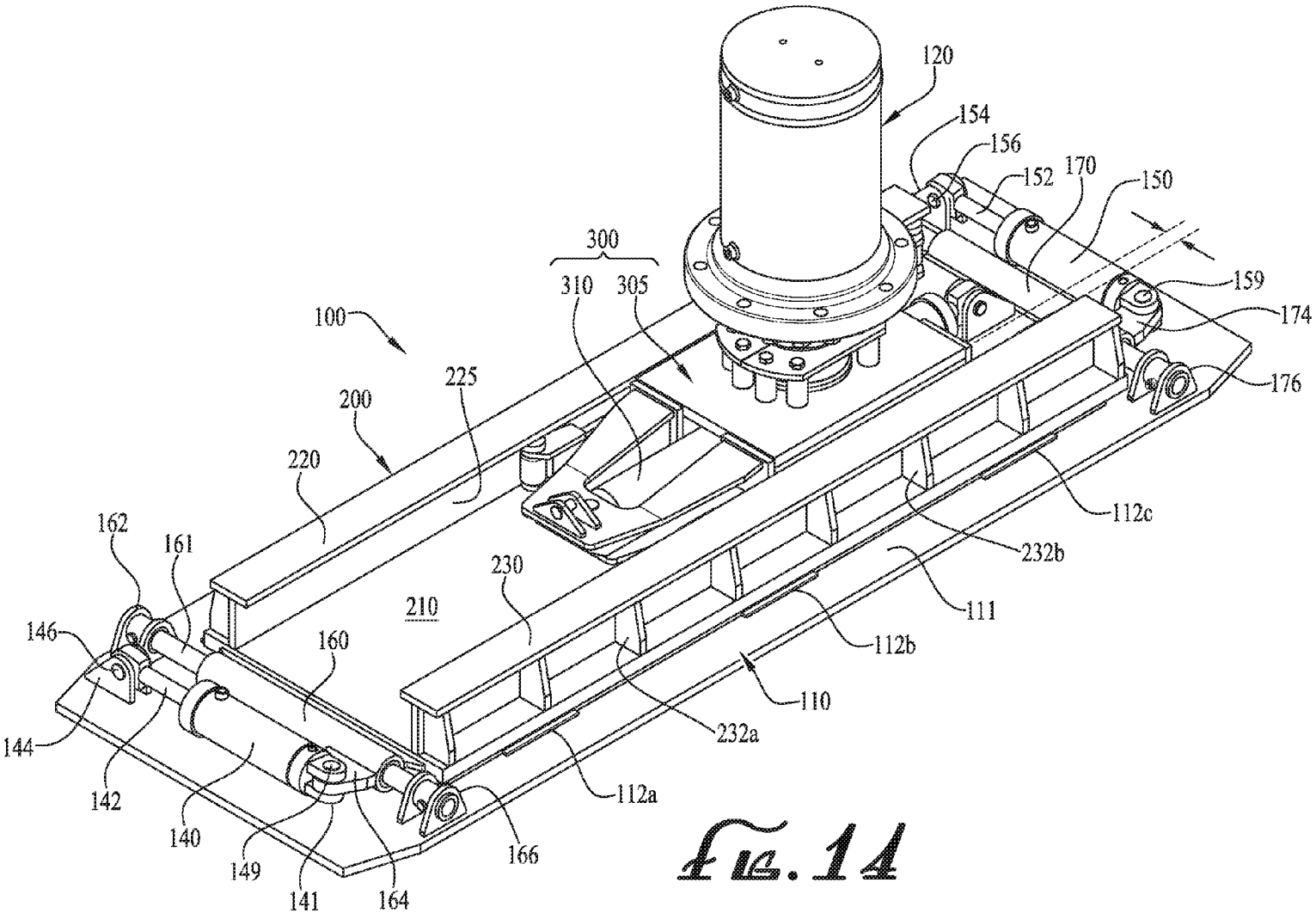
FIG. 14 is a top right rear isometric view of a walking machine unit according to an embodiment.
Figure 15:
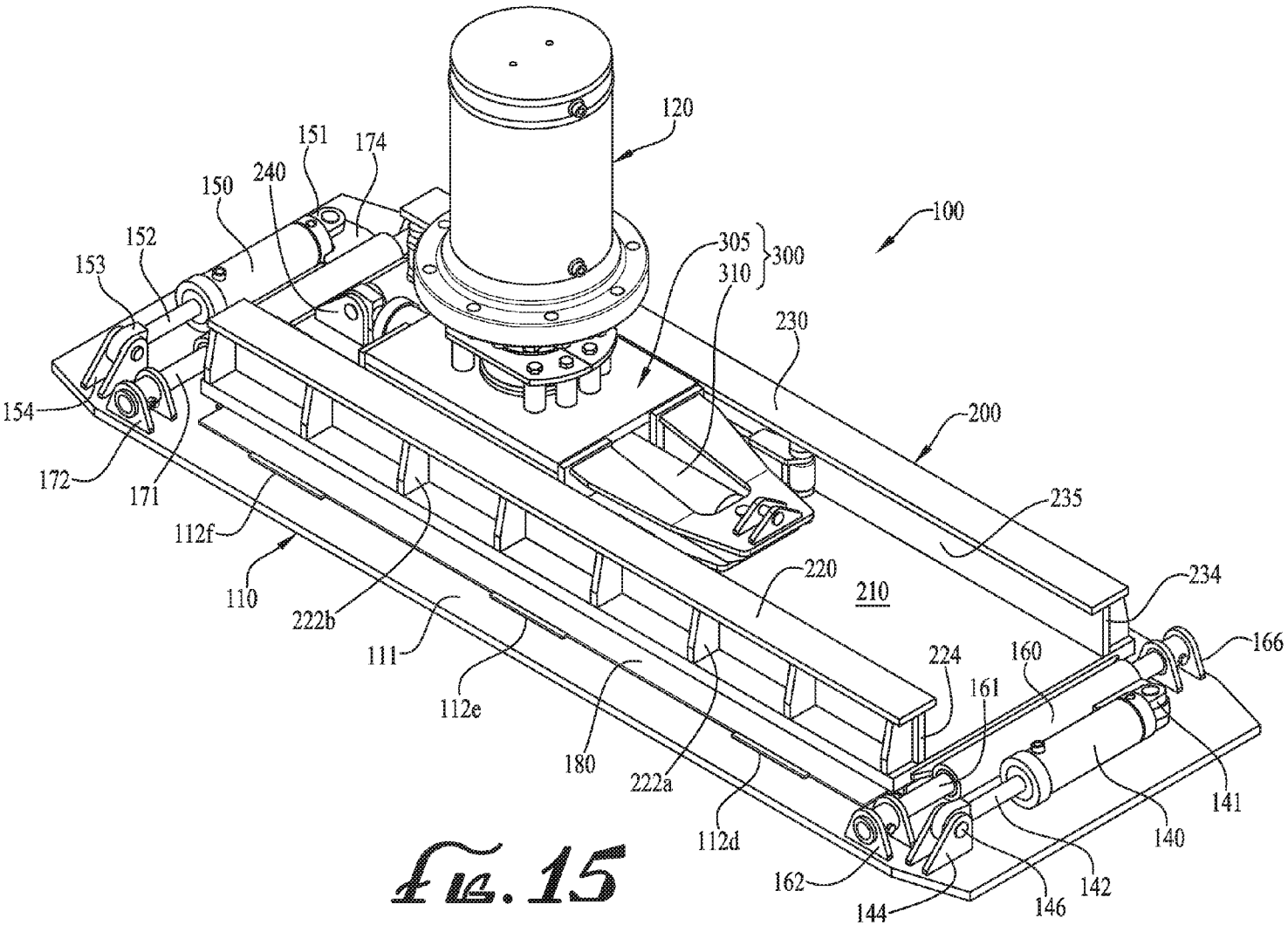
FIG. 15 is a top left rear isometric view of the walking machine unit of FIG. 14.
Figure 16:
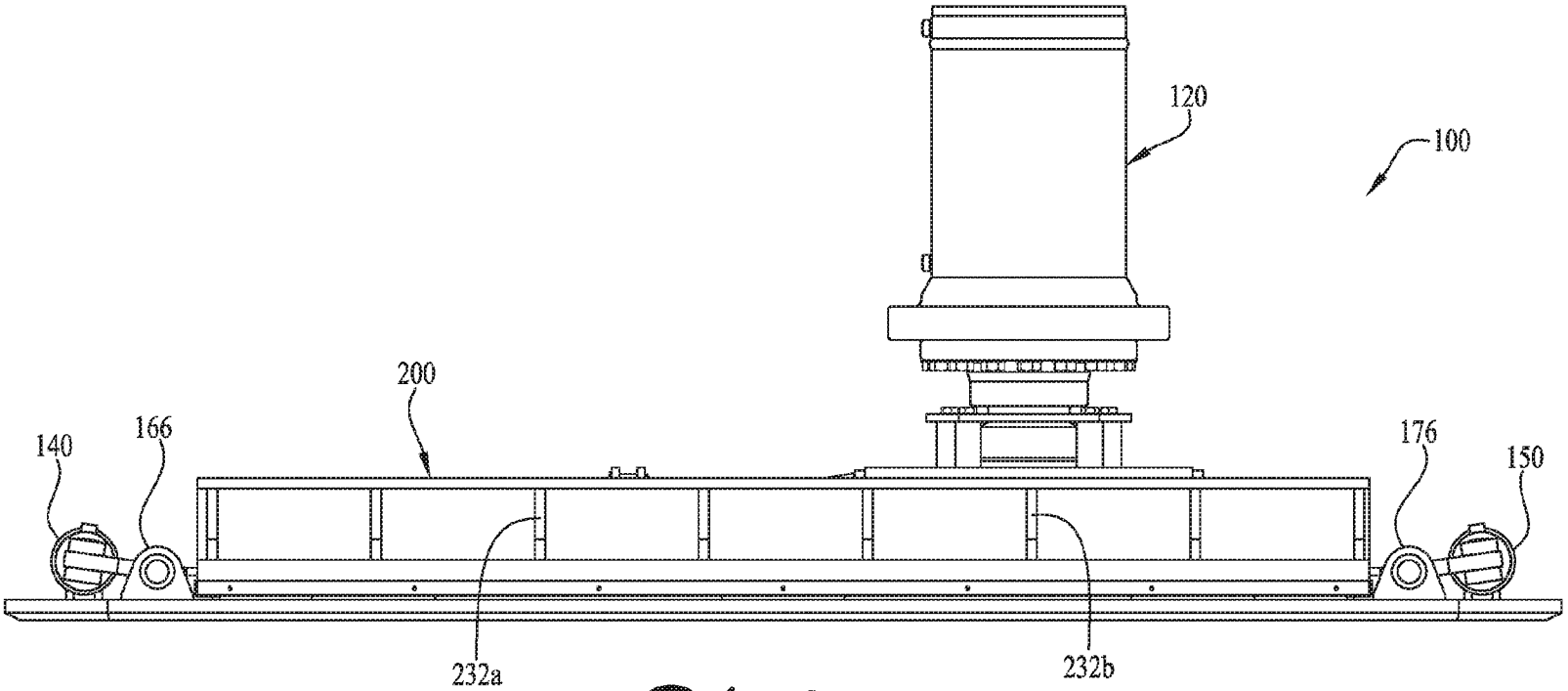
FIG. 16 is a right side elevation view of the walking machine unit of FIG. 14.

FIGS. 9-13 illustrate one side of the walking machine system and two of the walking machine units 100, 102 in various positions. In FIGS. 9 and 13 the walking machine units 100, 102 are illustrated in the first longitudinal, non-extended or rearward, travel position, and laterally centered (similar to FIG. 8). The isometric view of FIG. 13 further illustrates the forward walking machine unit disposed within the cross beams 52, 54 of the substructure 50 and also illustrates the rear lifting assembly with cross beams of the substructure 50 removed. In FIG. 10 the walking machine units 100, 102 are illustrated in the second longitudinal, forward-extended, travel position, and laterally centered. In FIG. 11 the walking machine units 100, 102 are illustrated in the first longitudinal, non-extended or rearward, travel position, and laterally to the right side. In FIG. 12 the walking machine units 100, 102 are illustrated in the first longitudinal, non-extended or rearward, travel position, and laterally to the left side. Though not shown, the walking machine units may be translated into the second longitudinal, forward-extended, travel position, and laterally translated to the left or right.

FIGS. 14-43 illustrate details of the walking machine unit 100 according to an embodiment. The walking machine unit 100 basically comprises a foot plate assembly or foot section 110, an upper roller guide assembly 200 (with lateral drive), a longitudinal drive assembly 300, and a lift assembly 400.

FIGS. 14-29 illustrate details of the structure and drive system for the lateral translation mechanism according to an embodiment. The foot section 110 comprises a foot plate 111 which contacts the ground surface during a walking motion of the walking machine unit 100. The foot section 110 comprises a foot plate 111 of generally rectangular shape with somewhat up-curved ends. Though the foot plate 111 may alternatively be another suitable shape such as oblong or circular, the elongated rectangular structure may enable the walking machine unit 100 to have a longer longitudinal travel stroke with a solid/stable footprint. The foot section 110 includes a plurality of retainer bars secured to and arranged about the upper surface of the foot plate 111: retainer bars 112*a*, 112*b*, 112*c* on one lateral side; retainer bars 112*d*, 112*e*, 112*f* on the opposite side; retainer bars 112*g*, 112*h* on the front side; and retainer bars 112*i*, 112*j* on the rear side. A slide plate 180, which may be constructed of stainless steel, is disposed flat on the central portion of the foot plate 111 nesting between the retainer bars 112*a-j*. The slide plate 180 thus remains free-floating, but its lateral and longitudinal position is maintained centrally within and flat against the foot plate 111. Alternatively the slide plate 180 may be attached to the foot plate 111 such as by welding or connectors (e.g., screws or bolts), but the floating construction may better manage expansion/contraction issues due to different expansion coefficients of the steel types and may also provide for easier construction and/or repair/replacement or allow for expansion of a non-composite plate configuration due to deflection of the foot plate/slide.

A low friction plate 190 comprising a flat bushing is disposed on the lower surface of the roller guide assembly 200 to provide for a low friction slide surface between the roller guide assembly 200 and the slide plate 180. The low friction plate 190 may be made of nylon (e.g., a lubricant filled plastic such as Nylatron® plastic available from Quadrant EPP USA, Inc. of Reading, Pa.), PTFE, bronze or other metal, or other suitable plate/sheet material or coated plate. In other embodiments, a lubrication, e.g., grease, may be applied to the slide plate 180. Alternately, the positions of the slide plate 180 and the low friction plate 190 may be reversed. Alternately, instead of a low friction slide surface configuration, roller bearings or other suitable bearing or roller assembly system may be employed to provide for low friction lateral movement.

The roller guide assembly 200, details of which are shown in FIGS. 26-29, comprises a main or bottom plate 210 and first and second roller support sides. The first roller support side comprises a top plate 230 and a vertical wall 234 forming a generally I-beam cross-section with the bottom plate 210. The top plate 230, vertical wall 234 and bottom plate 210 form a channel 235. The top plate 230 is secured to the vertical wall 234 and the bottom plate 210 via a series of eight stiffening ribs, two of which are designated by element numerals 232*a* and 232*b*. Similarly, the second roller support side comprises a top plate 220 and a vertical wall 224 forming a generally I-beam cross-section with the bottom plate 210. The top plate 220, vertical wall 224 and bottom plate 210 form a channel 225. The top plate 220 is secured to the vertical wall 224 and the bottom plate 210 via a series of eight stiffening ribs, two of which are designated by element numerals 222*a* and 222*b*.

Guide tubes 160, 170 are attached to the bottom plate 210 on opposite longitudinal sides. The guide tube 160 includes an attachment bracket 164, and the guide tube 170 includes an attachment bracket 174. The roller guide assembly 200 is mounted to the foot plate 111 via the guide tubes 160, 170 to allow lateral movement. Guide bars 161, 171 are disposed on opposite longitudinal sides of the foot plate 111. Guide bar 161 is secured to the foot plate 111 via brackets 162, 166, and guide bar 171 is secured to the foot plate 111 by brackets 172, 176. Brackets 144, 154 are also secured onto the foot plate 111 for attachment to the lateral drive cylinders 140, 150. A cylindrical sleeve or bushing 160*a* of low friction material (e.g., nylon or other suitable material) may be installed within the guide tube 160 and around the guide bar 161, and a cylindrical sleeve or bushing 170*a* of low friction material is similarly installed within the guide tube 170 and around the guide bar 171.

The lateral drive force is provided by lateral drive cylinders 140 and 150 attached between the roller guide assembly 200 and the foot plate 111. The drive cylinder 140 is connected at one end 141 to the bracket 164 via a pin 149, and at its second end 145 on piston shaft 142 to the bracket 144 on foot plate 111 via pin 146. Similarly on the other side, the drive cylinder 150 is connected at one end 151 to the bracket 174 via a pin 159, and at its second end 155 on piston shaft 152 to the bracket 154 on foot plate 111 via pin 156. Alternate lateral drive force may be provided by any suitable drive mechanism including the piston/cylinder drive (as illustrated), jack screw drive, rack and pinion assembly, chain and sprocket drive, gear drive, electric motor, or other drive systems.

The entire lift assembly 400 and roller guide assembly 200 thus are able to be translated laterally, driven by the hydraulic drive cylinders 140, 150, via sliding support surfaces. Further details of the sliding support surface combination are best shown in FIGS. 18-21. The slide plate 180 is disposed on the top surface of the foot plate 111, nesting within the frame established by the retainer bars 112*a-j*. The low friction plate 190, which may be about 1.5 inches thick (about 3.8 cm), is retained in position between the bottom plate 210 and the slide plate 180 via a retaining frame 192 arranged around the low friction plate 190. The retaining frame 192 may be made of steel and welded to the roller guide plate 210. The retaining frame 192 may be continuous and surround the low friction plate 190 on all sides, or may just be on two lateral sides. The retaining frame 192 may alternatively be intermittent, akin to the structure of the retainer bars 112*a-j*. The retainer bars 112*a-j* (see, for example, retainer bar 112*b* in FIG. 20) may have the same height as the slide plate 180. The retainer frame 192 has a lower height than the low friction plate 190 such that even with any compression of the low friction plate 190, a gap G is maintained between the retaining frame 192 and the slide plate 180, thus preventing or inhibiting metal-to-metal contact between the retaining frame 192 and the slide plate 180. Alternately, the low friction plate 190 may be mounted onto the foot plate 11 by a retaining frame secured to the foot plate 111 in essentially a reverse configuration to that illustrated.

A wiper 194 is provided along the outside perimeter of the retaining frame 192 and serves to span and cover the gap G, sliding along the upper surface of the slide plate 180 to inhibit debris from getting onto the surface of the slide plate 180 and/or between the slide plate 180 and the low friction plate 190.

The low friction plate 190 may be attached to the lower surface of the roller guide plate 210, or it may merely be free-floating, kept in position by the retainer frame 192 disposed about its outer perimeter. Alternately, instead of the low friction plate 190 and slide plate 180, a roller system may be provided to provide for low friction movement between the foot section 110 and the upper roller guide assembly 200.

The longitudinal drive assembly 300 comprises a roller assembly 305 and drive cylinder 310. The roller assembly 305 includes a roller housing section 320 of generally rectangular box shape formed with two internal channels 331, 335 for accommodating the rollers 334, 336. The first internal channel 331 is formed by side walls 326*a*, 326*b*, with roller plate 334 attached to the side walls 326*a*, 326*b*. The second internal channel 335 is formed by side walls 324*a*, 324*b*, with roller plate 336 attached to the side walls 324*a*, 324*b*. The rollers 334, 336 may comprise chain roller bearings such as available from Hilman Incorporated of Marlboro, N.J. Other low friction or reduced friction systems may be employed for the longitudinal drive assembly 300 in place of the roller assembly 305, such as other types of bearings, slide surfaces (e.g., a plate bushing), or other suitable construction.

The roller assembly 305 includes centering springs 360, 350 disposed on its lateral sides. Centering spring 360 is connected along side wall 326*a*, and centering spring 350 is connected along side wall 324*a*. Rollers 362, 364 are disposed on the ends of the centering spring 360 and travel along the channel 225 in the roller guide assembly 200. Rollers 352, 354 are disposed on the ends of the centering spring 350 and travel along the channel 235 in the roller guide assembly 200. A slide pad 366 is attached along a center outside portion of the spring 360 for providing a low friction sliding surface against the vertical wall 224. A slide pad 356 is attached along a center portion of the centering spring 350 for providing a low friction sliding surface against the vertical wall 234. The centering springs 350, 360 comprise leaf springs that allow for some lateral movement to accommodate for some misalignment during the drive operation when moving the load, and then serve to re-center the roller assembly 305 when the load is released.

The roller assembly 305 includes a drive connection bracket assembly including a U-shaped upper bracket 370 and a U-shaped lower bracket 380. An attachment bracket 374 is disposed on the end of the upper bracket 370. A hole 372 is disposed in the end of the upper bracket 370 for connection to the longitudinal drive cylinder 310.

The longitudinal drive cylinder 310 is disposed within a central channel or opening between the (inner) side walls 326*b*, 324*b* and extends into the open inner portion of the U-shaped brackets 370, 380. The longitudinal drive cylinder 310 is connected at one end (the shaft end) 312 to bracket 240 on the upper roller guide assembly 200 via a pin 313 and on the other end 314 to upper and lower brackets 370, 380 via a pin 315 through the hole 372 in the upper bracket 370 and a corresponding hole in the lower bracket 380.

The walking machine system includes a control system for controlling the operation of the walking machine units 100, 102, 104, 106. Each walking machine unit, for example walking machine unit 100, is provided with a hydraulic control system for operating the lift mechanism 120, the longitudinal drive mechanism (longitudinal drive cylinder 310) and the lateral drive mechanism (lateral drive cylinders 140, 150). The longitudinal drive system may operate independently or in combination (i.e., simultaneously) with the operation of the lateral drive system. Thus the lifting mechanism and load may be controlled/operated to transport the lifting assembly and load in any direction: forward, backward, sideward (left or right), or diagonally at any desired angle or direction. In addition, by operating the front walking machine units 102, 106 in one lateral direction (such as left or diagonally left) and the rear walking units 100, 104 in another lateral direction (such as right or diagonally right) the oil rig 10 may be rotated.

Though the longitudinal drive mechanism is shown for example as a hydraulic drive system comprising the longitudinal drive cylinder 310, other types of longitudinal drive mechanisms may be employed such as the piston/cylinder drive (as illustrated), jack screw drive, rack and pinion assembly, chain and sprocket drive, gear drive, electric motor, or other drive systems.

FIGS. 34-39 illustrate various longitudinal and lateral drive positions for the walking machine unit 100.

Figure 17:
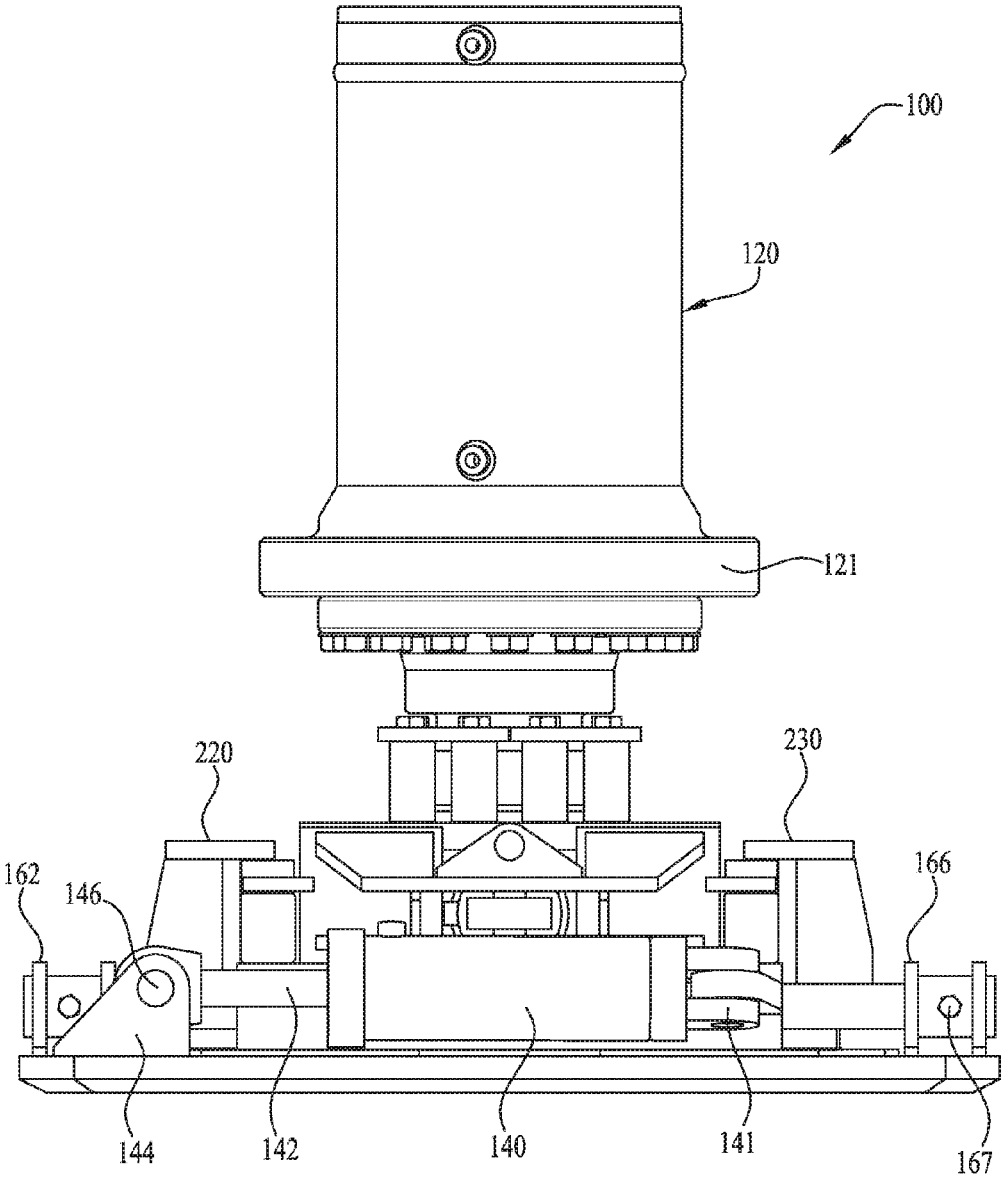
FIG. 17 is a rear side elevation view of the walking machine unit of FIG. 14.
Figure 18:
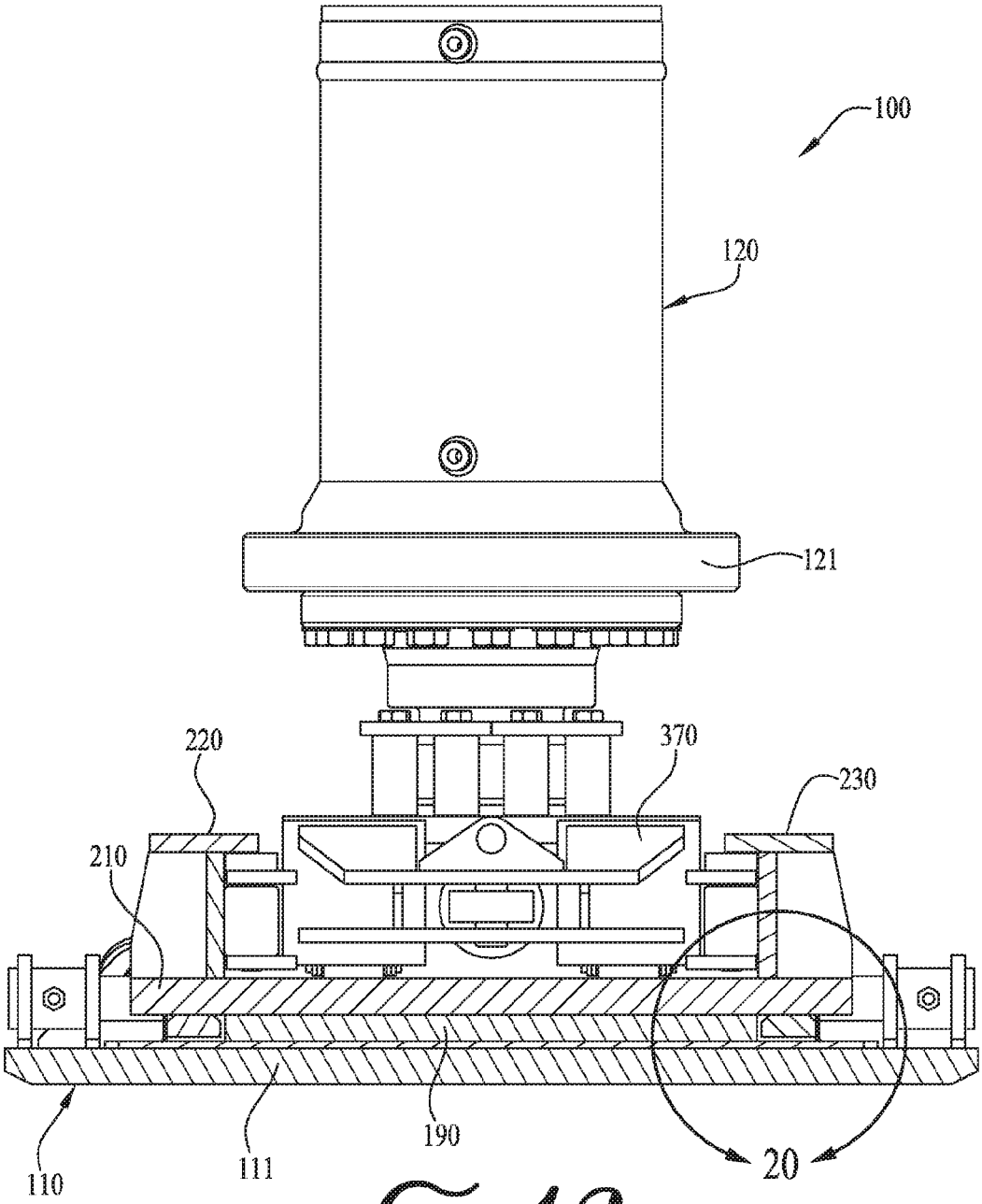
FIG. 18 is partial cross-sectional view of FIG. 19 taken along line 18-18.
Figure 19:
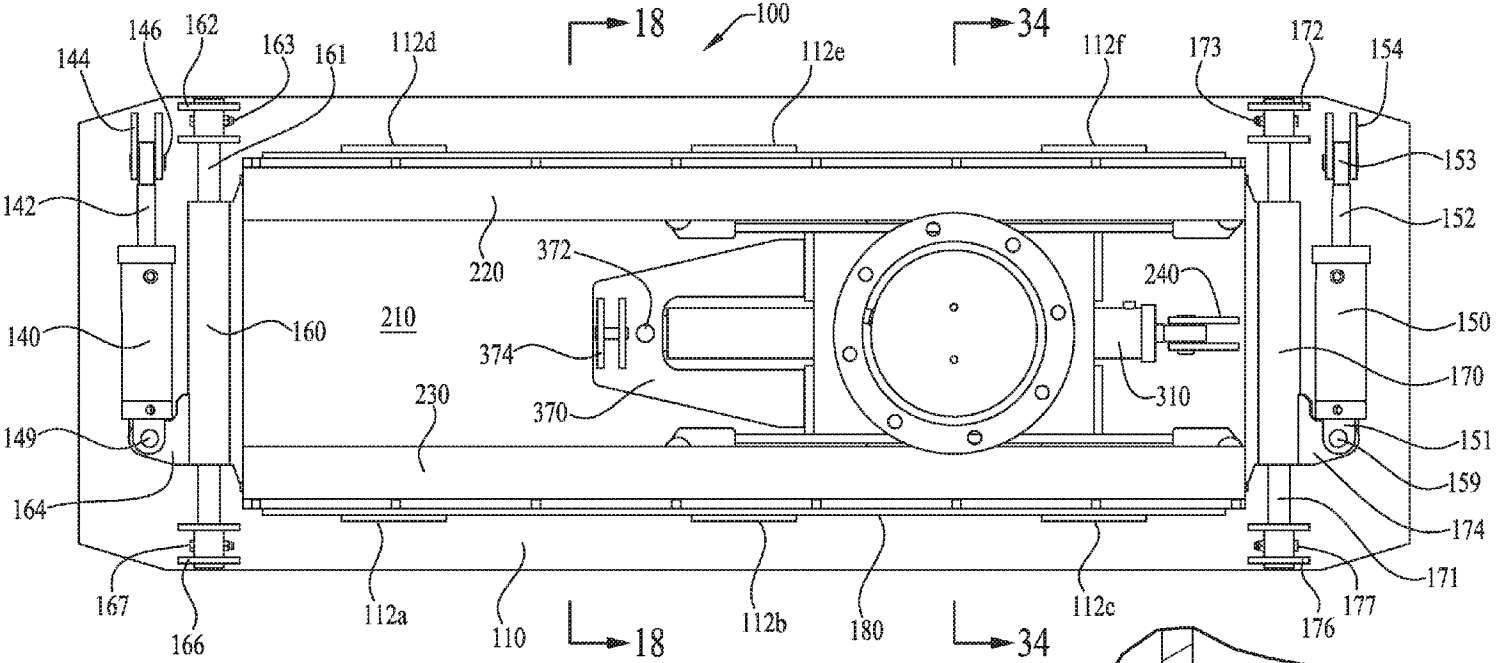
FIG. 19 is a top plan view of the walking machine unit of FIG. 14.
Figure 20:
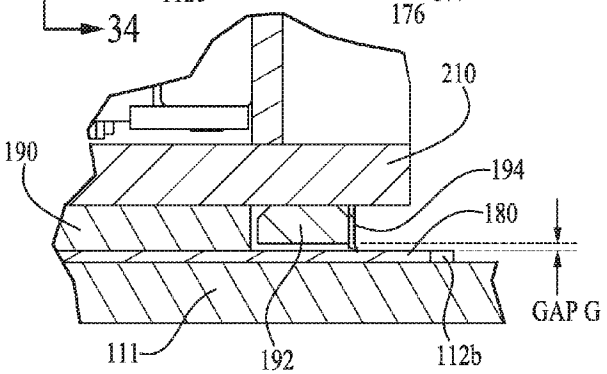
FIG. 20 is a detailed view of a portion of FIG. 18 on an enlarged scale.
Figure 21:
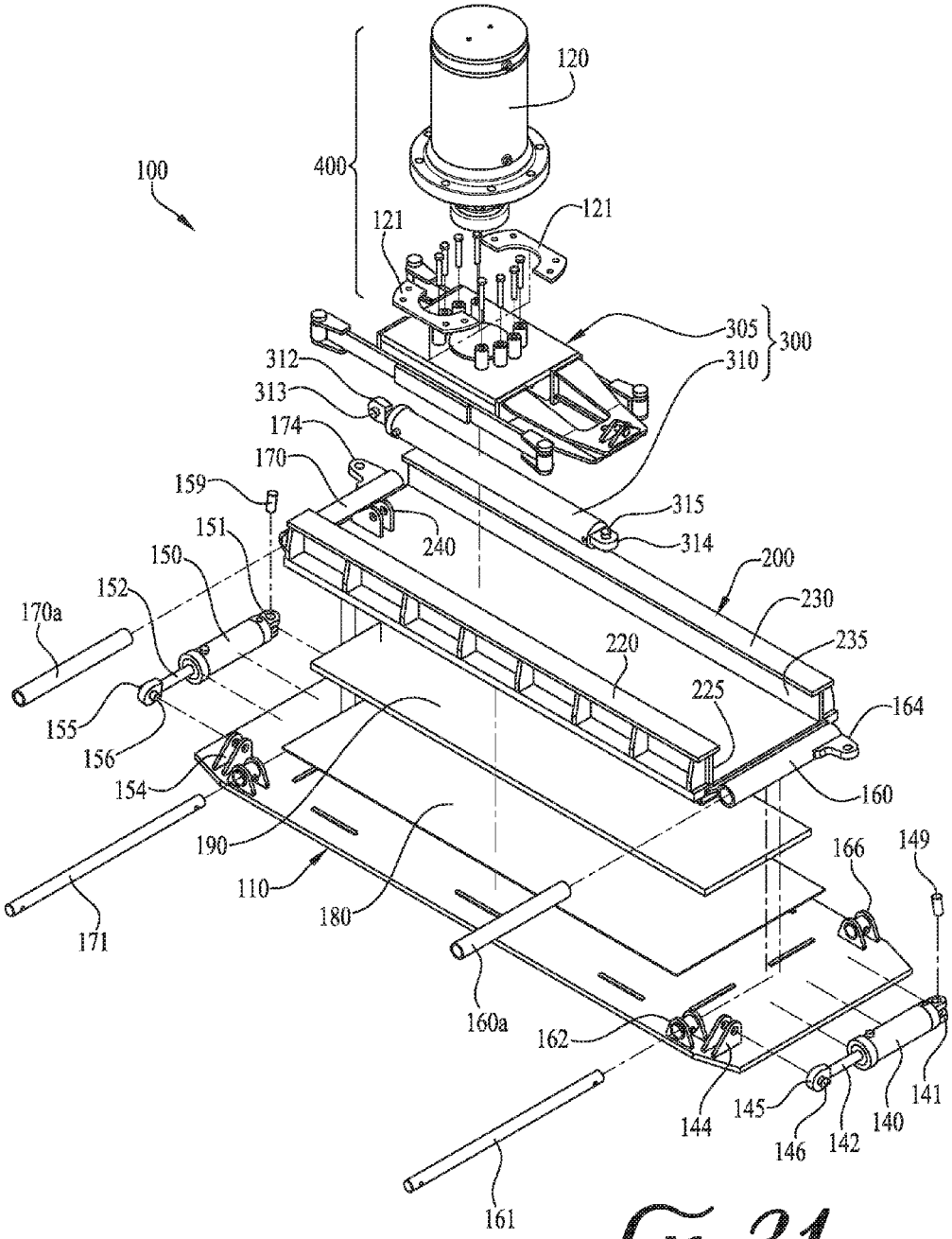
FIG. 21 is a partially exploded isometric view of the walking machine unit in FIG. 14.
Figure 22:
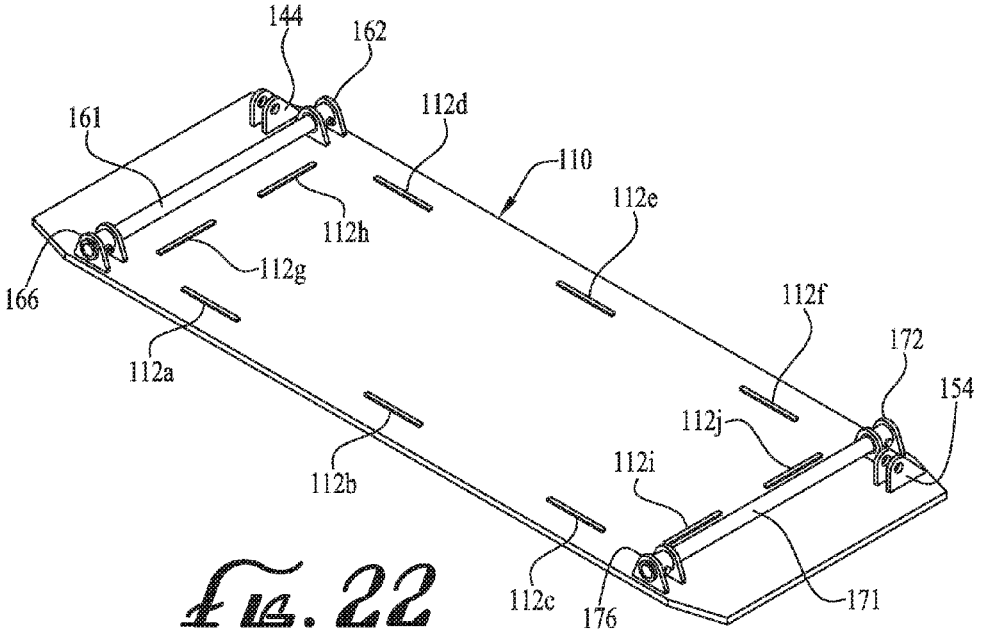
FIG. 22 is an isometric view of a foot section of the walking machine unit of FIG. 14.
Figure 23:
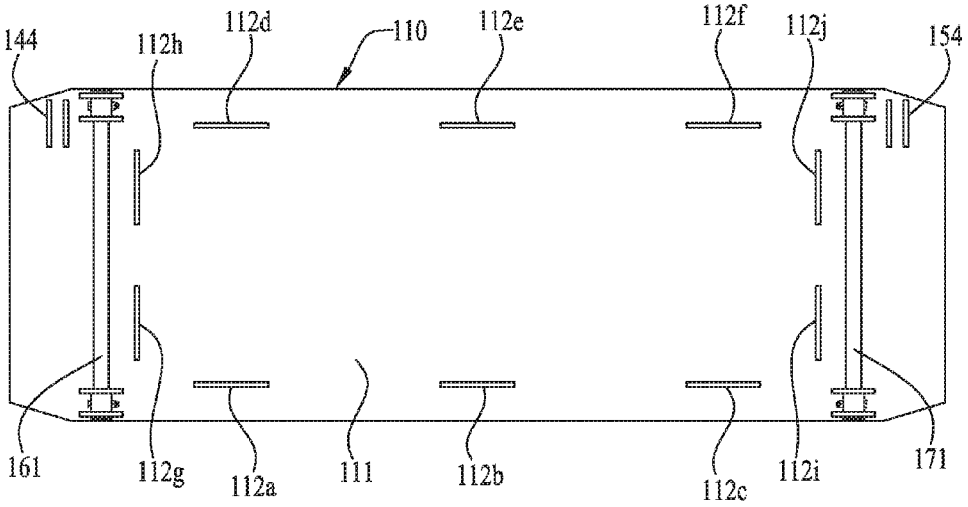
FIG. 23 is a top plan view of the foot section of FIG. 22.
Figure 24:
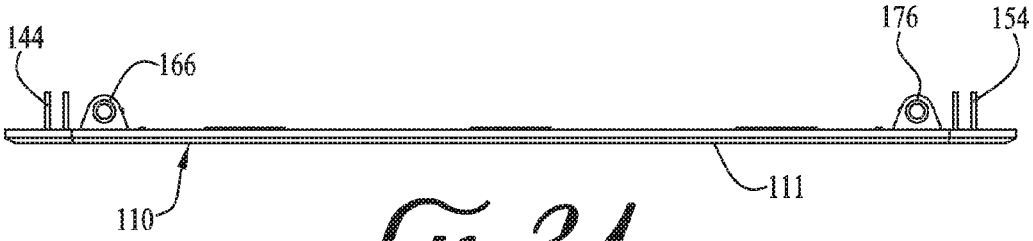
FIG. 24 is a right side elevation view of the foot section of FIG. 22.
Figure 25:
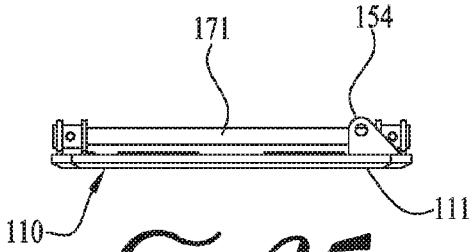
FIG. 25 is a front side elevation view of the foot section of FIG. 22.
Figure 26:
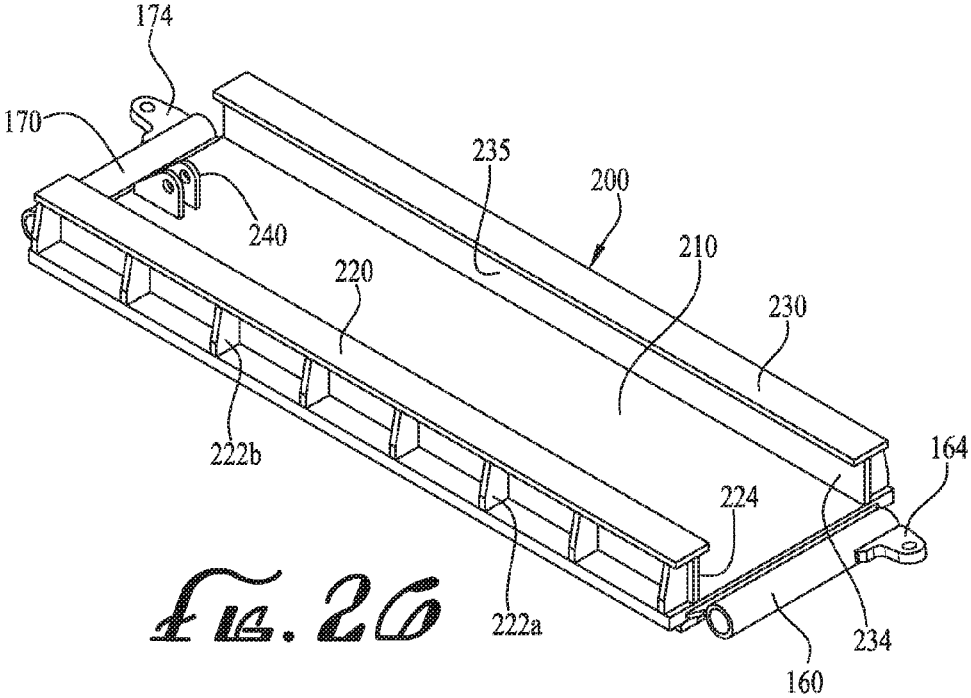
FIG. 26 is a top side isometric view of a roller guide section of the walking machine unit of FIG. 14.
Figure 27:
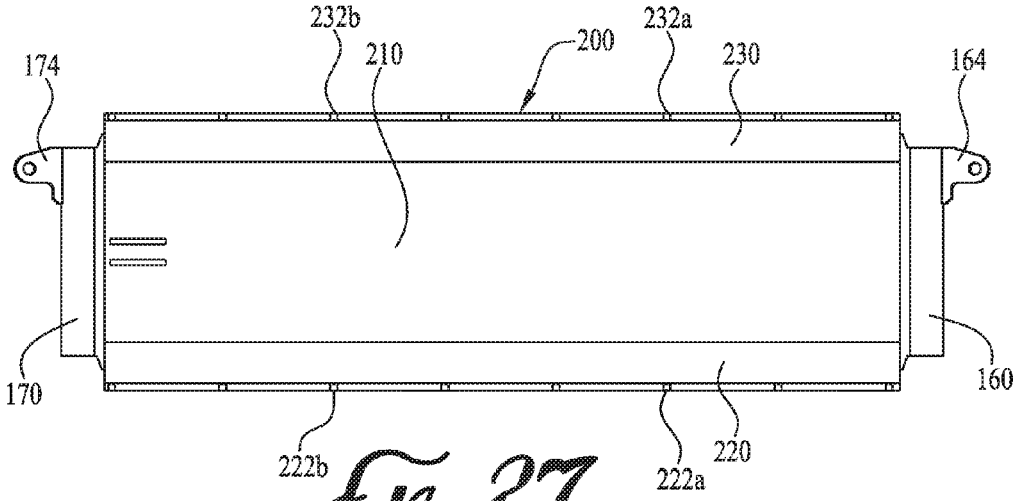
FIG. 27 is a top plan view of the roller guide section of FIG. 26.
Figure 28:
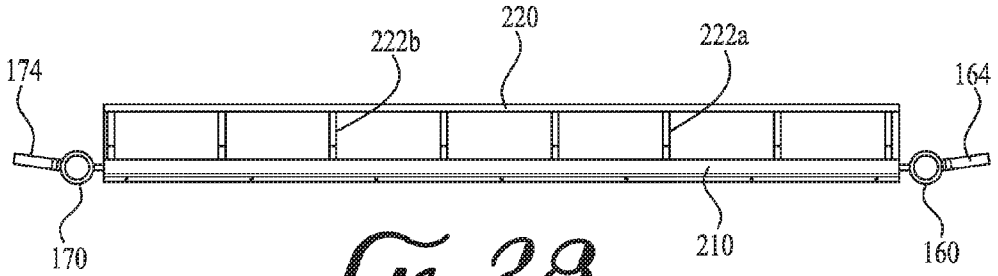
FIG. 28 is a right side elevation view of the roller guide section of FIG. 26.
Figure 29:
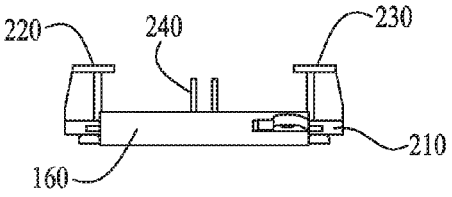
FIG. 29 is a front side elevation view of the roller guide section of FIG. 26.
Figure 30:
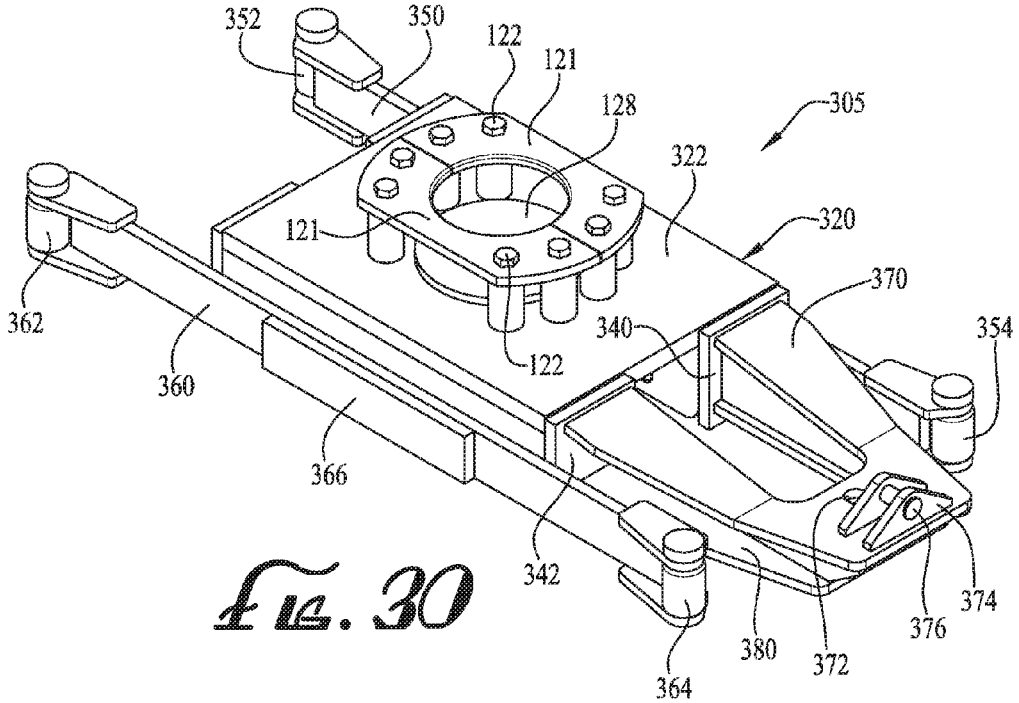
FIG. 30 is a top isometric view of a roller assembly of the walking machine unit of FIG. 14.
Figure 31:
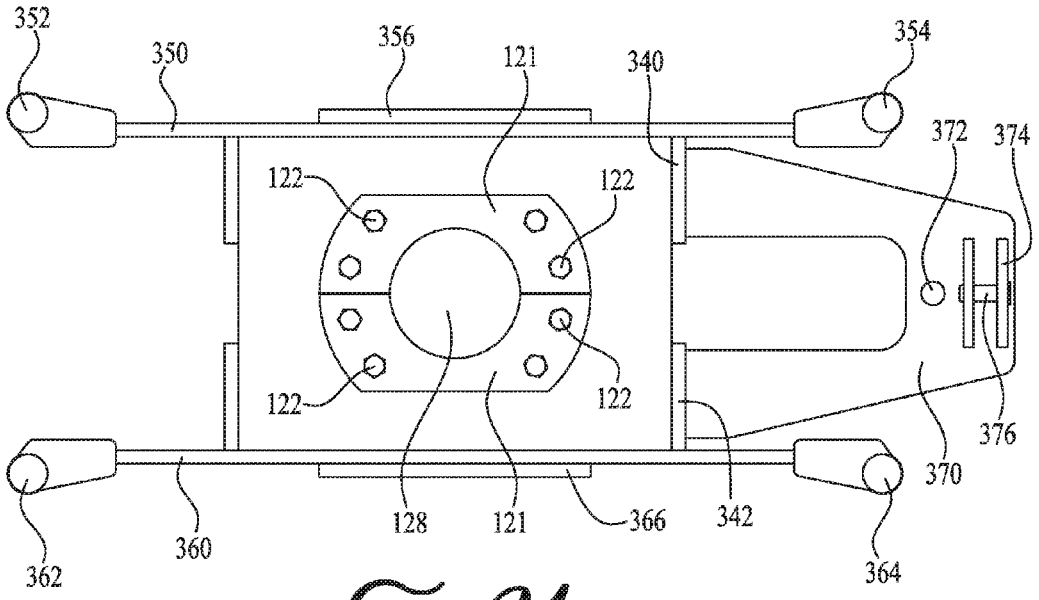
FIG. 31 is top plan view of the roller assembly of FIG. 30.
Figure 32:
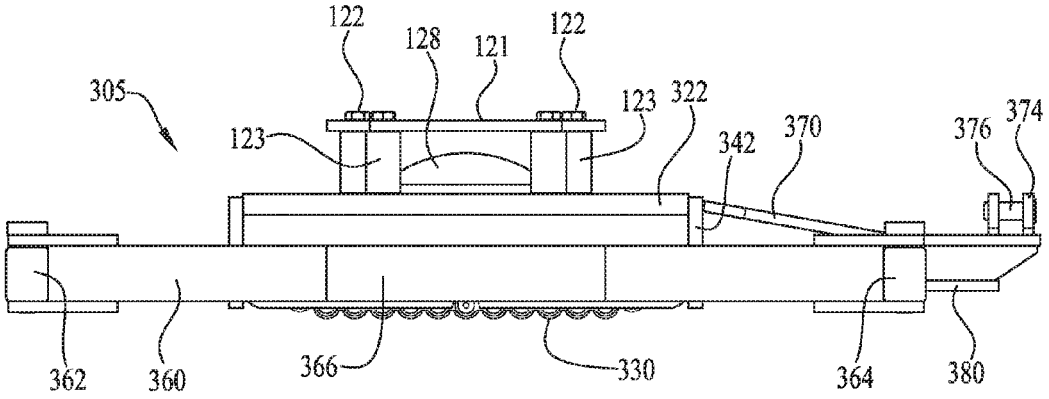
FIG. 32 is a right side elevation view of the roller assembly of FIG. 30.
Figure 33:
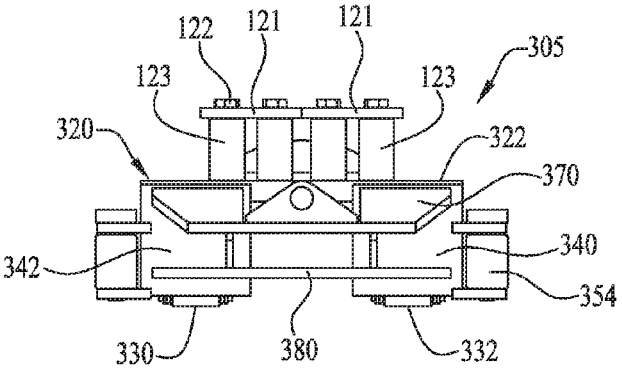
FIG. 33 is a front side elevation view of the roller assembly of FIG. 30.
Figure 34:
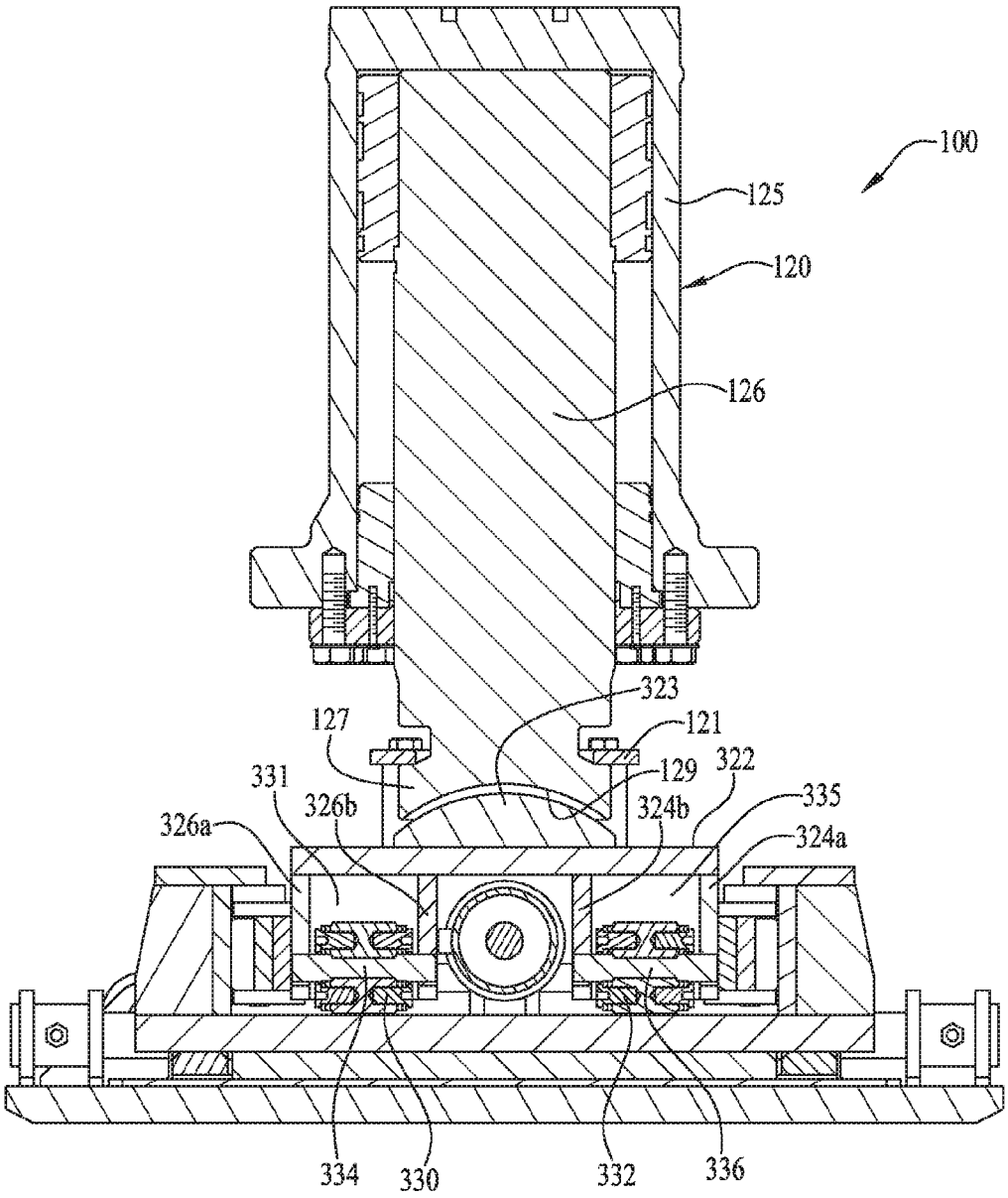
FIG. 34 is a cross-sectional view of FIG. 19 taken along lines 34-34.

FIG. 34, in combination with FIGS. 17 and 19, illustrates the walking machine unit 100 with the longitudinal drive in the fully retracted position and the lateral drive in a centered position, FIG. 17 being a front side elevation view, FIG. 19 being a top side plan view, and FIG. 34 being a partial cross-sectional view of FIG. 19.

Figure 35A:
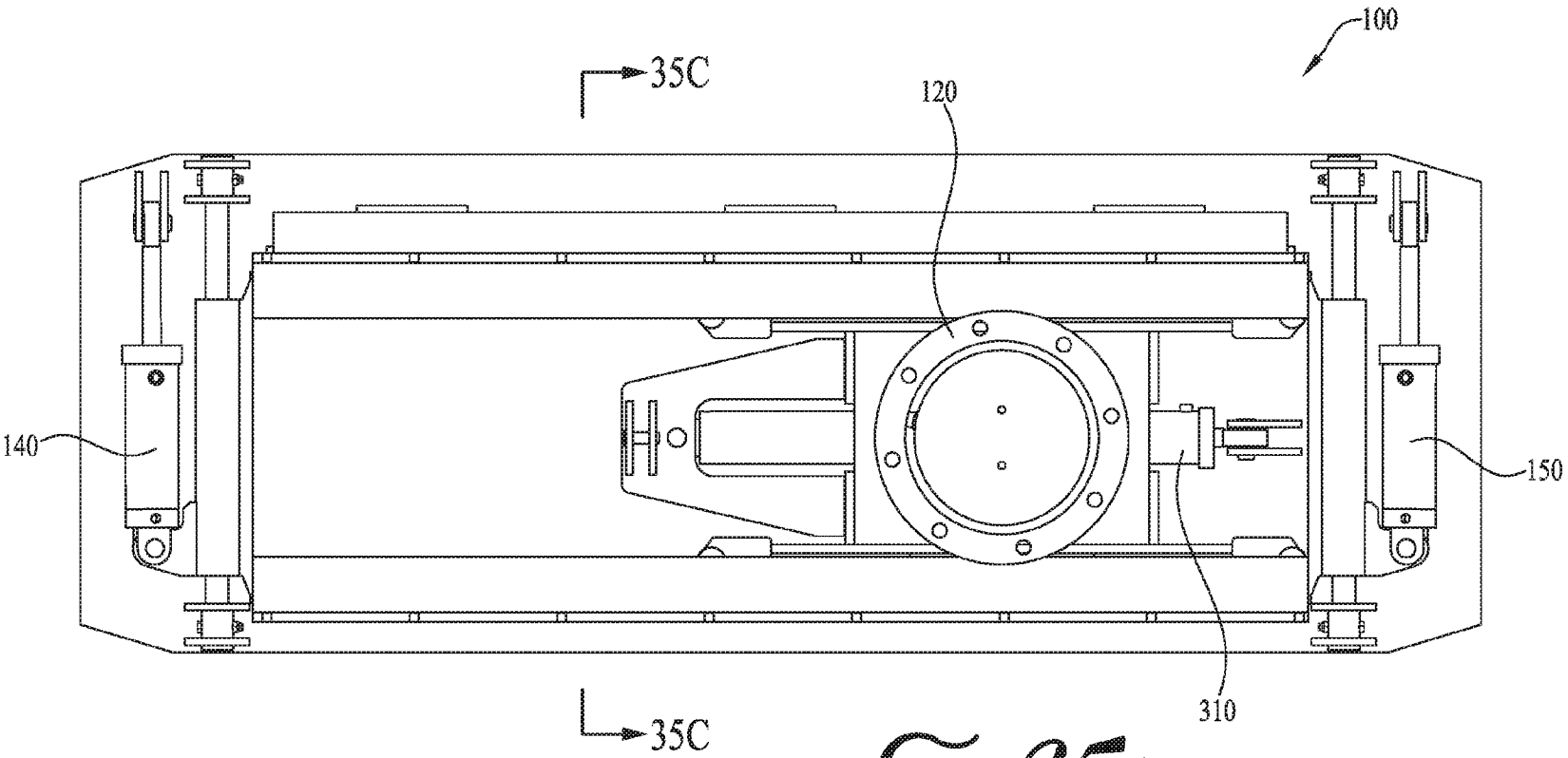
FIGS. 35A, 35B and 35C illustrate the walking machine unit of FIG. 14 with the longitudinal drive in the fully retracted position and the lateral drive in the fully extended position, FIG. 35A being a top plan view, FIG. 35B a front side elevation view, and FIG. 35C a partial cross-sectional view of FIG. 35B taken along lines 35C-35C.
Figure 35C:
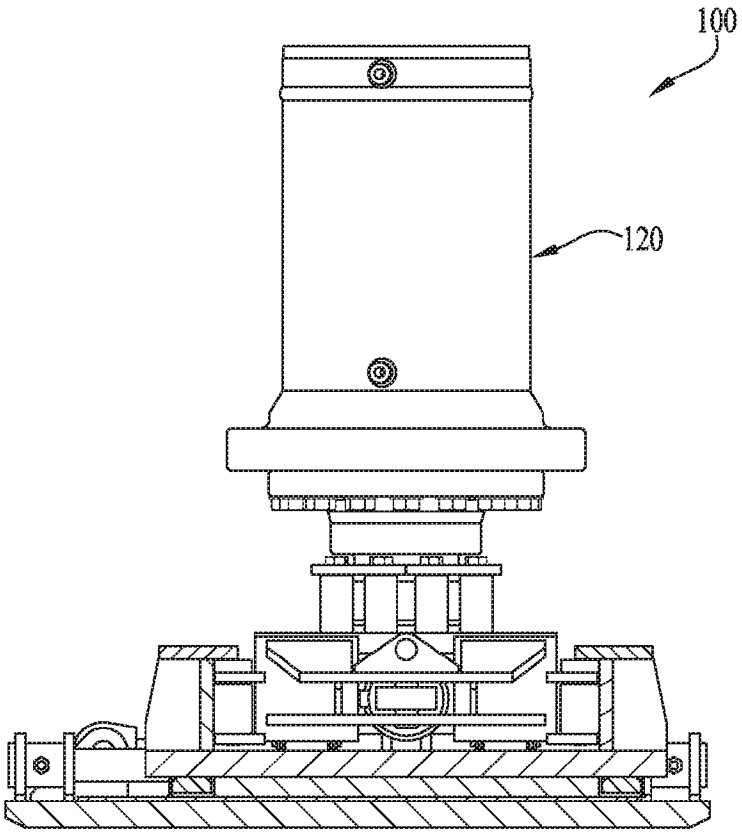
Figure 35B:
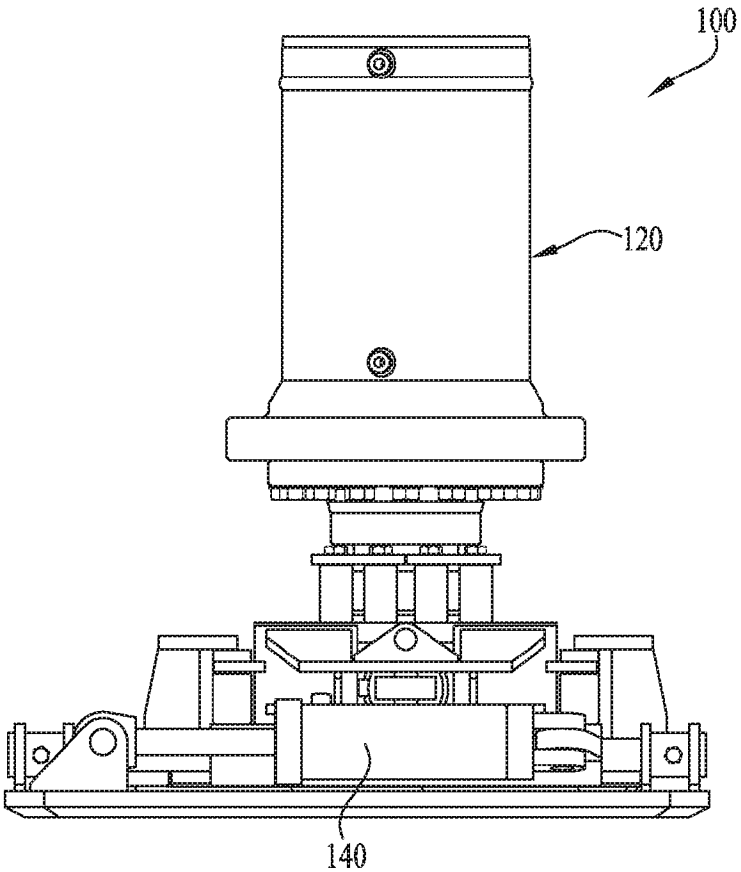
Figure 30A:
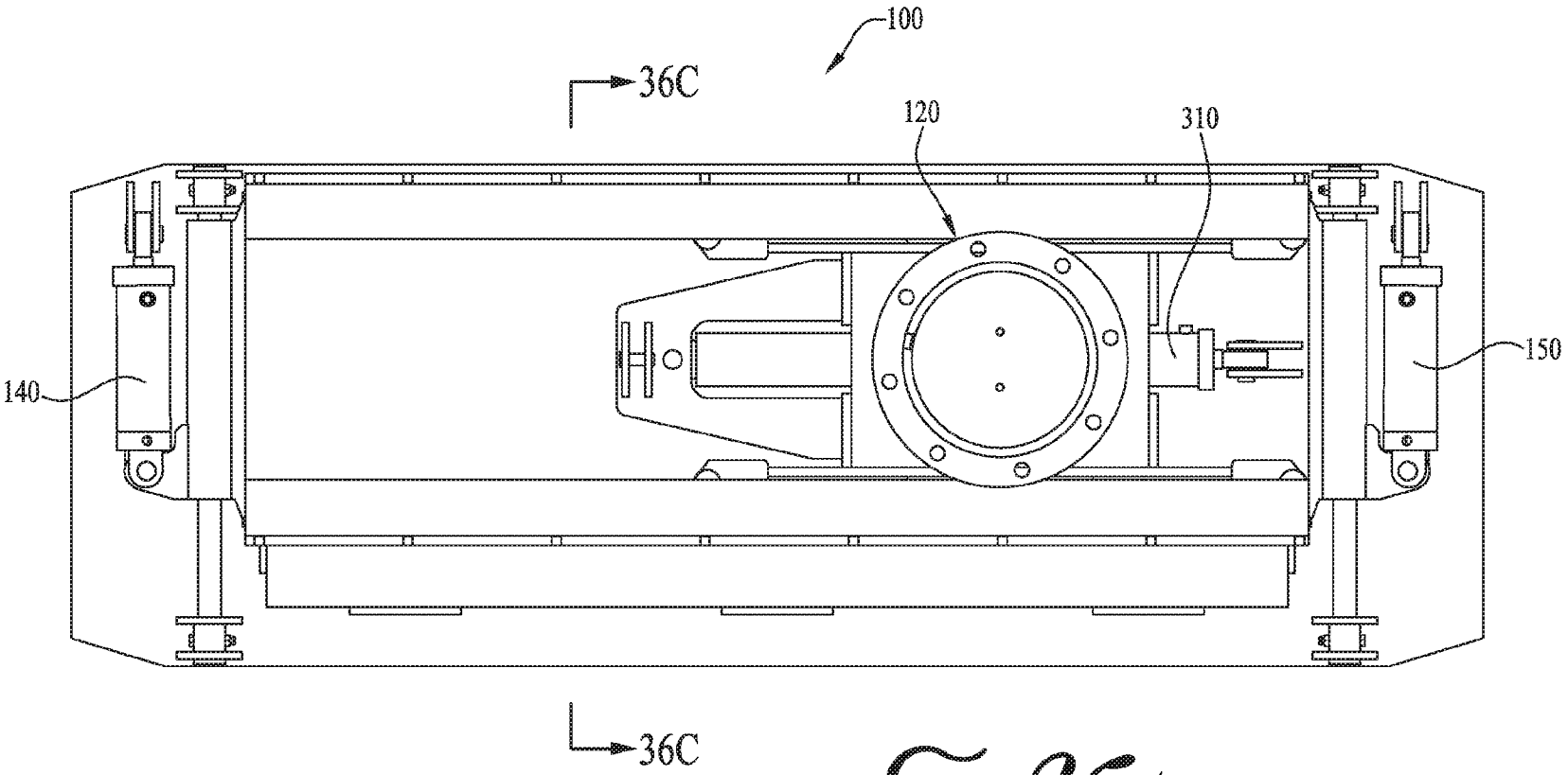
Figure 30C:
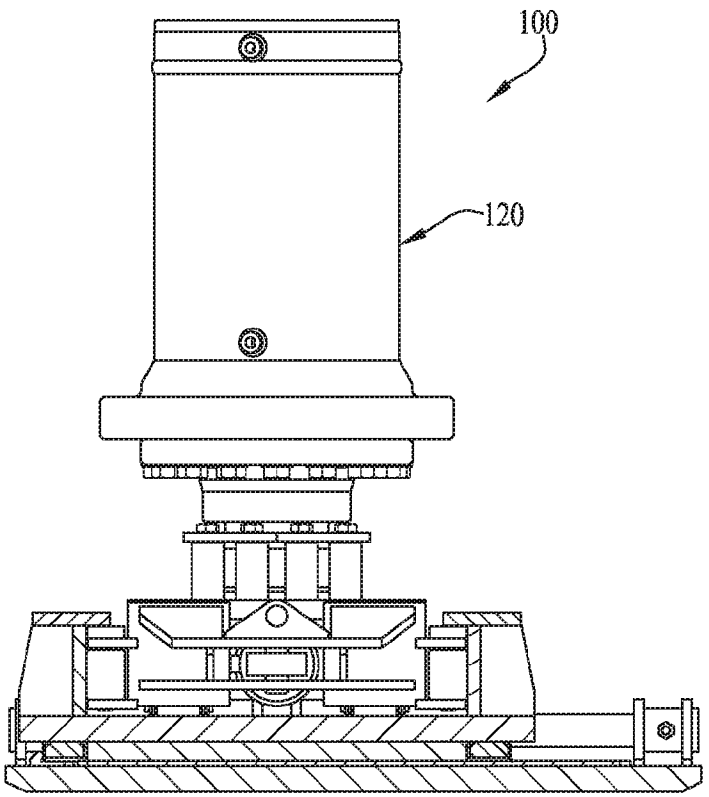
Figure 30B:
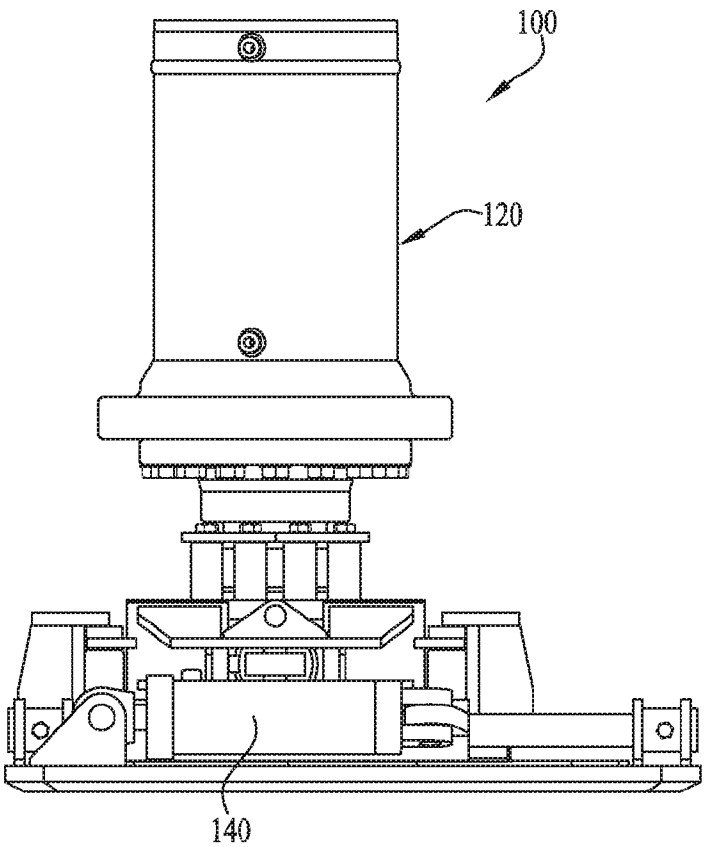

FIGS. 35A, 35B and 35C illustrate the walking machine unit 100 with the longitudinal drive in the fully retracted position and the lateral drive in the fully extended position, FIG. 35A being a top plan view, FIG. 35B a front side elevation view, and FIG. 35C a partial cross-sectional view of FIG. 35B.

FIGS. 36A, 36B and 36C illustrate the walking machine unit 100 with the longitudinal drive in the fully retracted position and the lateral drive in the fully retracted position, FIG. 36A being a top plan view, FIG. 36B a front side elevation view, and FIG. 36C a partial cross-sectional view of FIG. 36B.

Figure 37A:
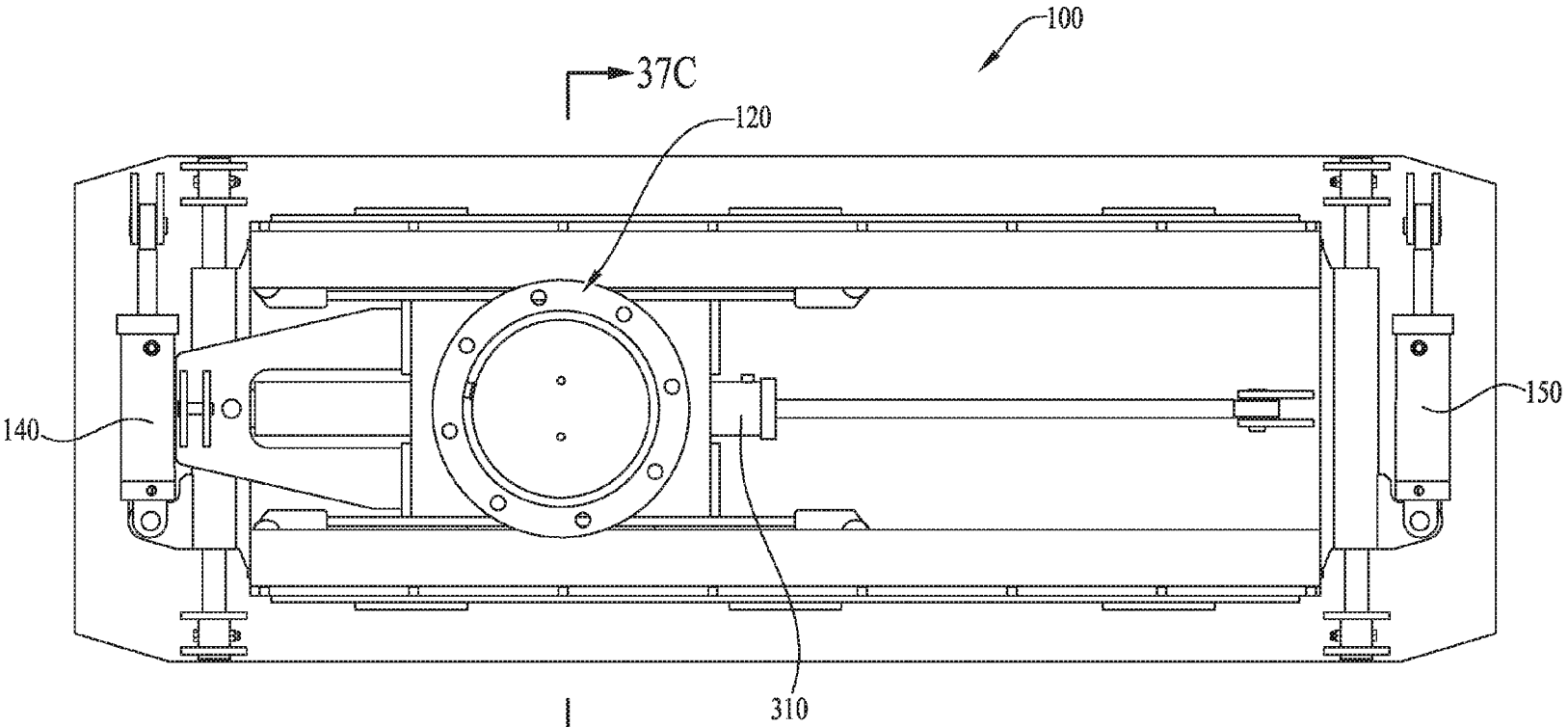
FIGS. 37A, 37B and 37C illustrate the walking machine unit of FIG. 14 with the longitudinal drive in the fully extended position and the lateral drive in the centered position, FIG. 37A being a top plan view, FIG. 37B a front side elevation view, and FIG. 37C a partial cross-sectional view of FIG. 37B taken along lines 37C-37C.
Figure 37C:
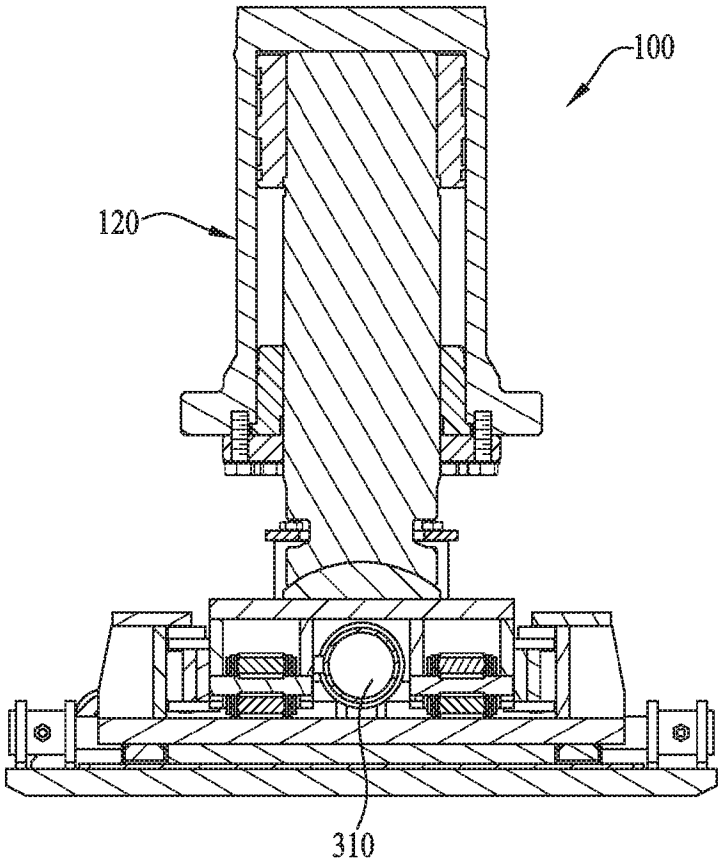
Figure 37B:
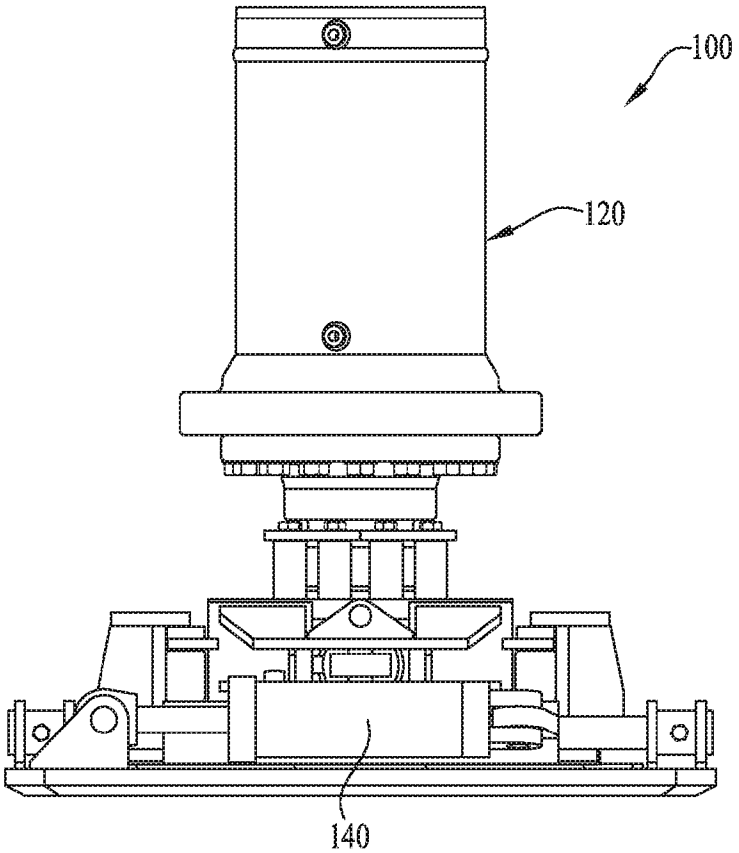

FIGS. 37A, 37B and 37C illustrate the walking machine unit 100 with the longitudinal drive in the fully extended position and the lateral drive in the centered position, FIG. 37A being a top plan view, FIG. 37B a front side elevation view, and FIG. 37C a partial cross-sectional view of FIG. 37B.

Figure 38A:
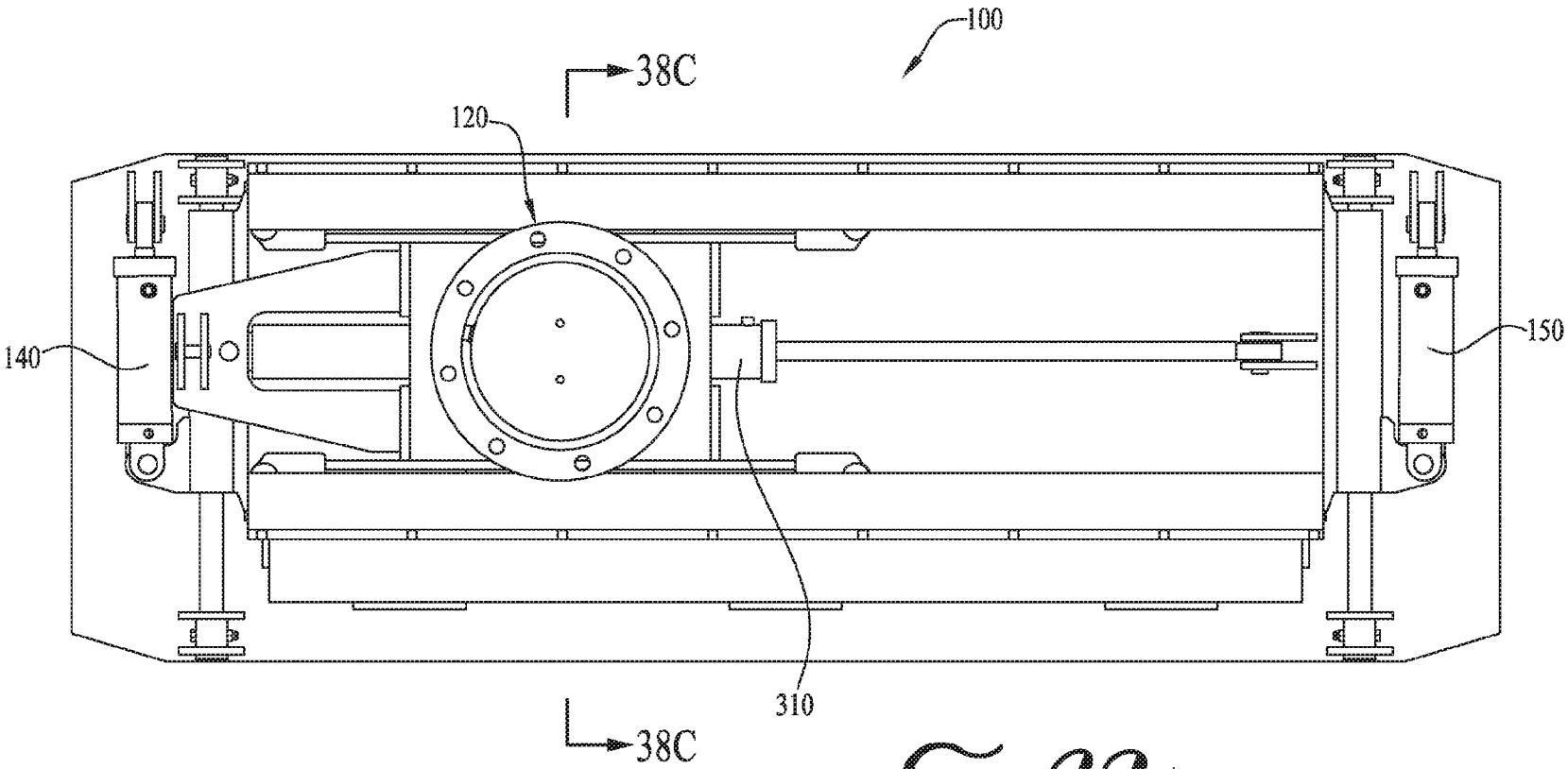
FIGS. 38A, 38B and 38C illustrate the walking machine unit of FIG. 14 with the longitudinal drive in the fully extended position and the lateral drive in the fully retracted position, FIG. 38A being a top plan view, FIG. 38B a front side elevation view, and FIG. 38C a partial cross-sectional view of FIG. 38B taken along lines 38C-38C.
Figure 38C:
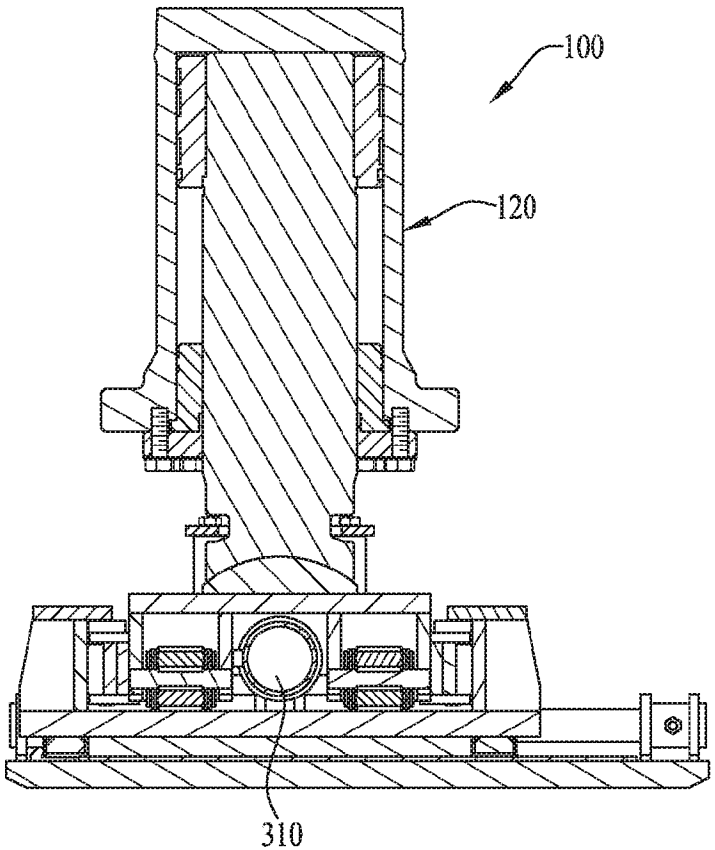
Figure 38B:
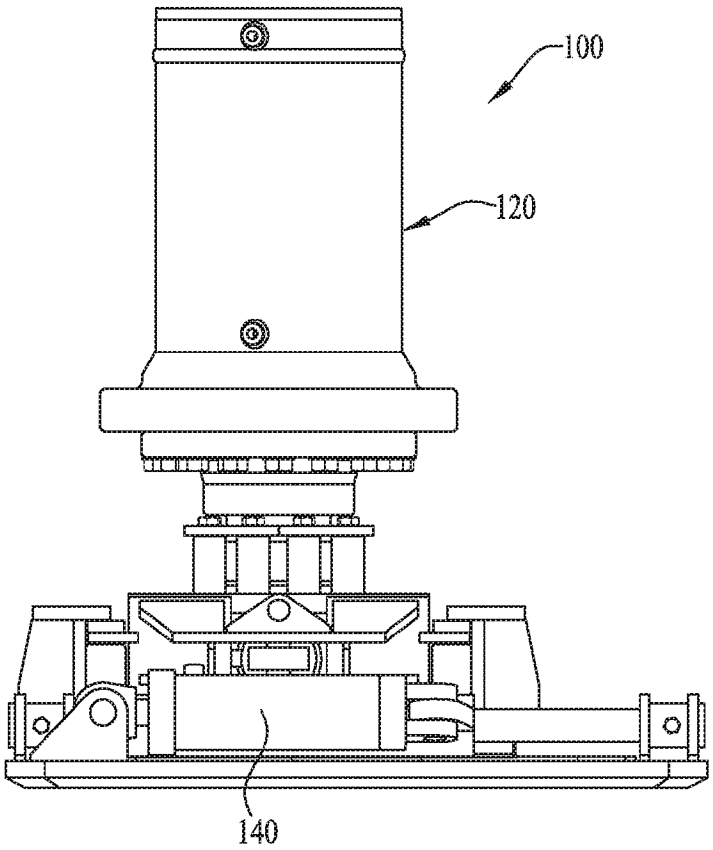

FIGS. 38A, 38B and 38C illustrate the walking machine unit with the longitudinal drive in the fully extended position and the lateral drive in the fully retracted position, FIG. 38A being a top plan view, FIG. 38B a front side elevation view, and FIG. 38C a partial cross-sectional view of FIG. 38B.

Figure 39A:
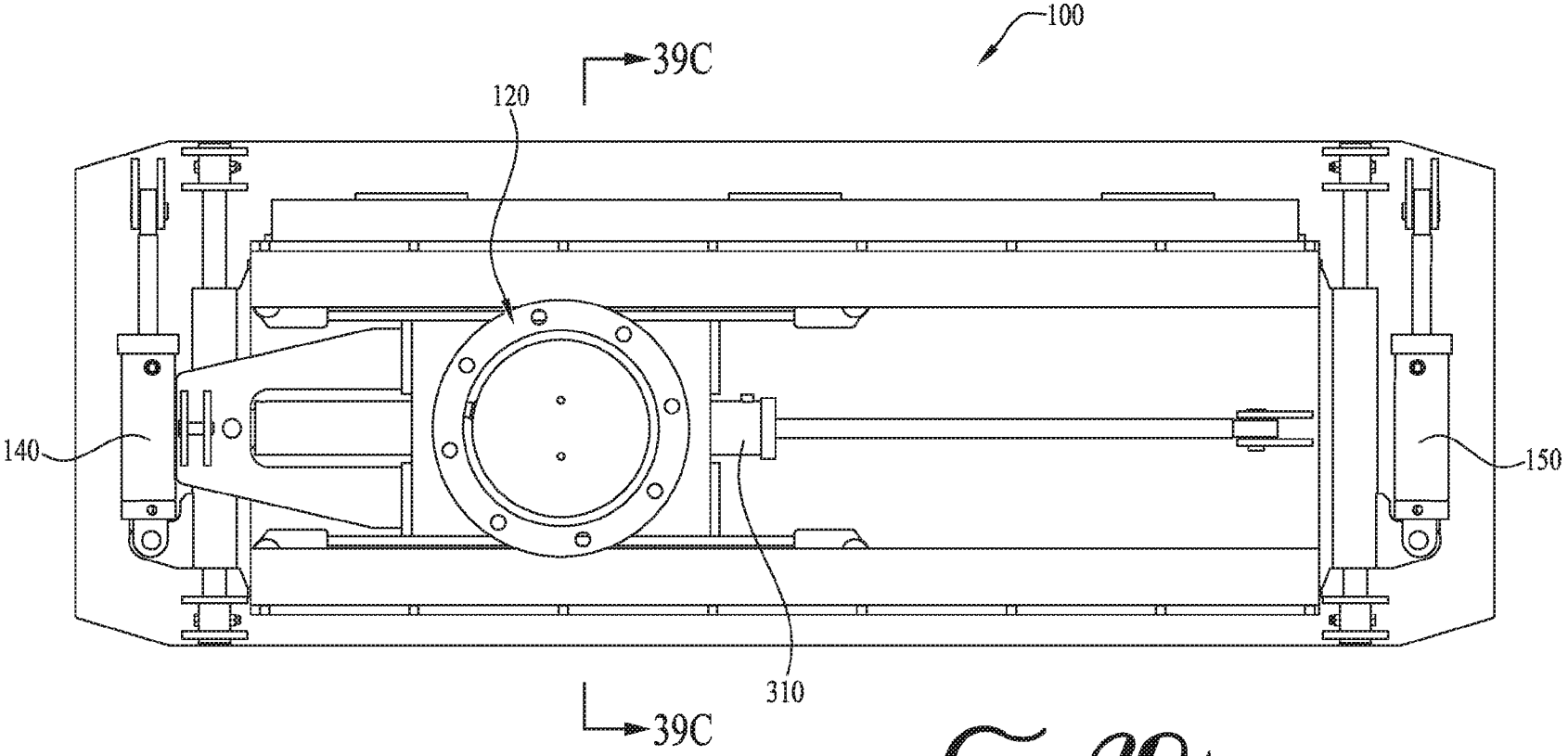
FIGS. 39A, 39B and 39C illustrate the walking machine unit of FIG. 14 with the longitudinal drive in the fully extended position and the lateral drive in the fully extended position, FIG. 39A being a top plan view, FIG. 39B a front side elevation view, and FIG. 39C a partial cross-sectional view of FIG. 39B taken along lines 39C-39C.
Figure 39C:
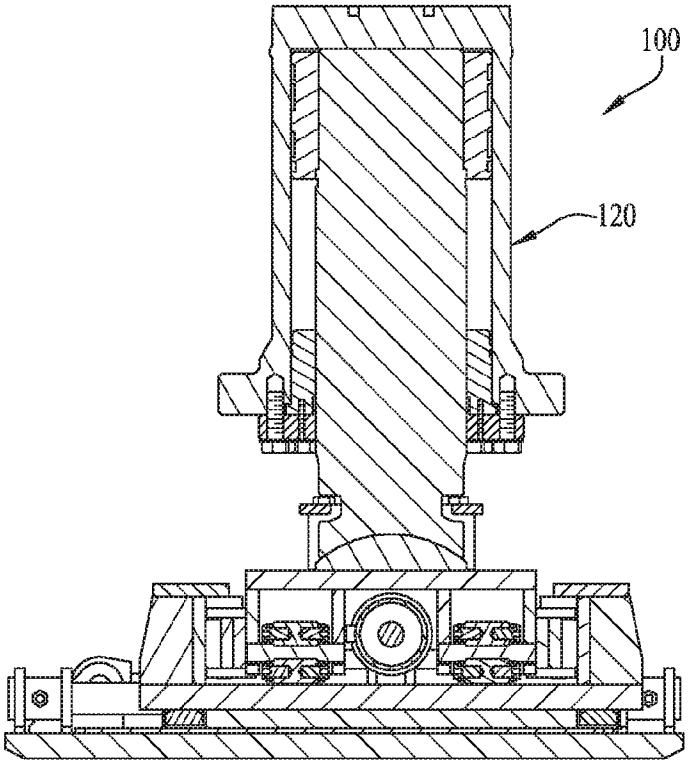
Figure 39B:
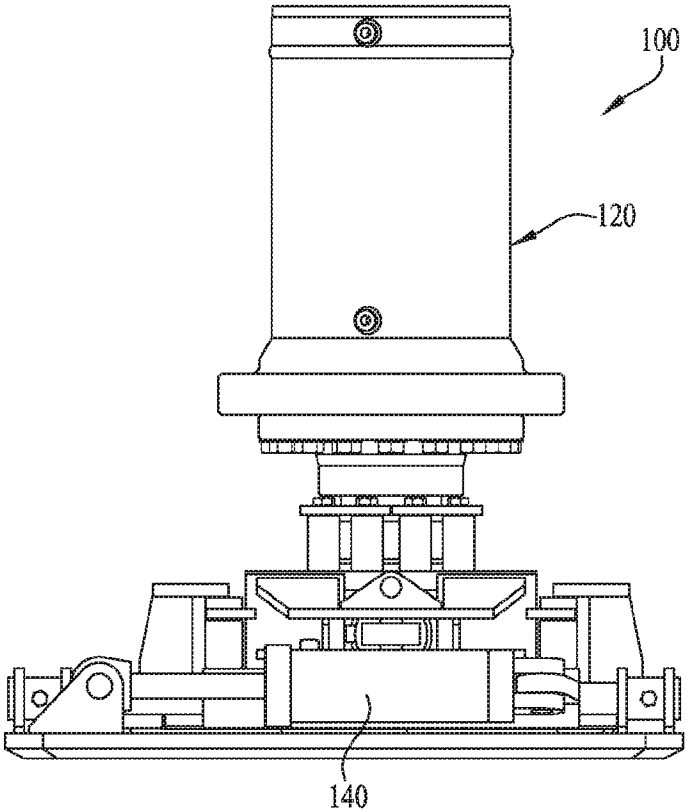

FIGS. 39A, 39B and 39C illustrate the walking machine unit 100 with the longitudinal drive in the fully extended position and the lateral drive in the fully extended position, FIG. 39A being a top plan view, FIG. 39B a front side elevation view, and FIG. 39C a partial cross-sectional view of FIG. 39B.

Prior walking units that required rotation of the lower walking mechanism in order to allow for lateral movement/steering had limitation on the length of the foot pad thus limiting longitudinal travel stroke. Since the walking machine unit 100 does not require rotation of the foot pad 110, it may be constructed with a longer foot pad 110 and thus produce a longer longitudinal stroke. In comparison to earlier units of comparable size and lift capability that have a typical stroke (in any direction) of about 15 inches (38 cm), the walking machine unit 100 may be constructed with a longitudinal stroke on the order of 48 inches (120 cm). The lateral stroke would still have the same structural limitations and would thus be on the order of 12 inches (30 cm). Moreover, since both lateral and longitudinal motion may be implemented in the same push-pull cycle, and steering rotation (and the time it takes to rotate the drive system) is not required, the walking unit 100 may travel at a much faster rate because of reduced reset times and due to the considerably longer longitudinal travel stroke.

It is noted that in FIGS. 8-39 the lift mechanism 120 is shown in the retracted condition. FIGS. 21 and 40-43 illustrate details of the lifting device and its operation according to an embodiment.

Figure 40:
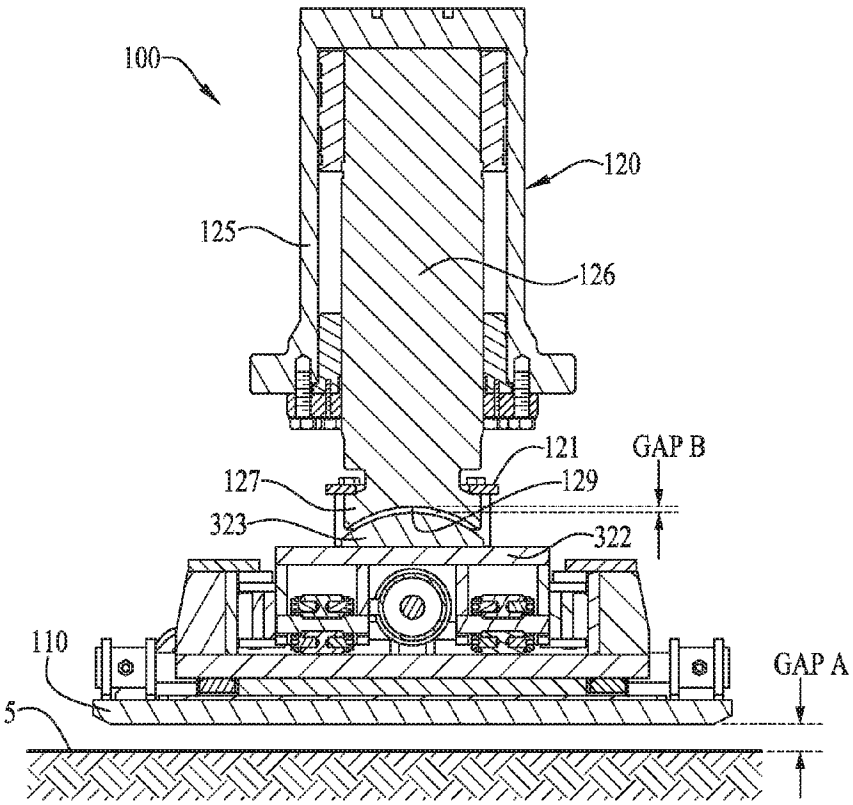
FIG. 40 is a partial cross-sectional view of the walking machine unit of FIG. 14 illustrating a lifting device with the lift mechanism in a first (fully) retracted position, with the foot pad lifted off the ground.
Figure 13:
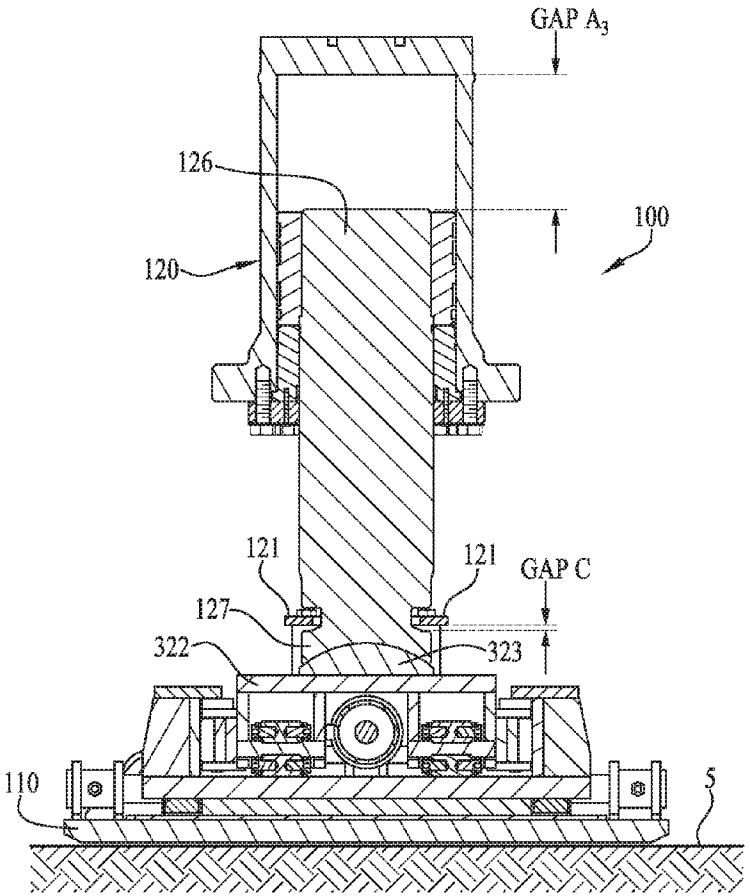
Figure 12:
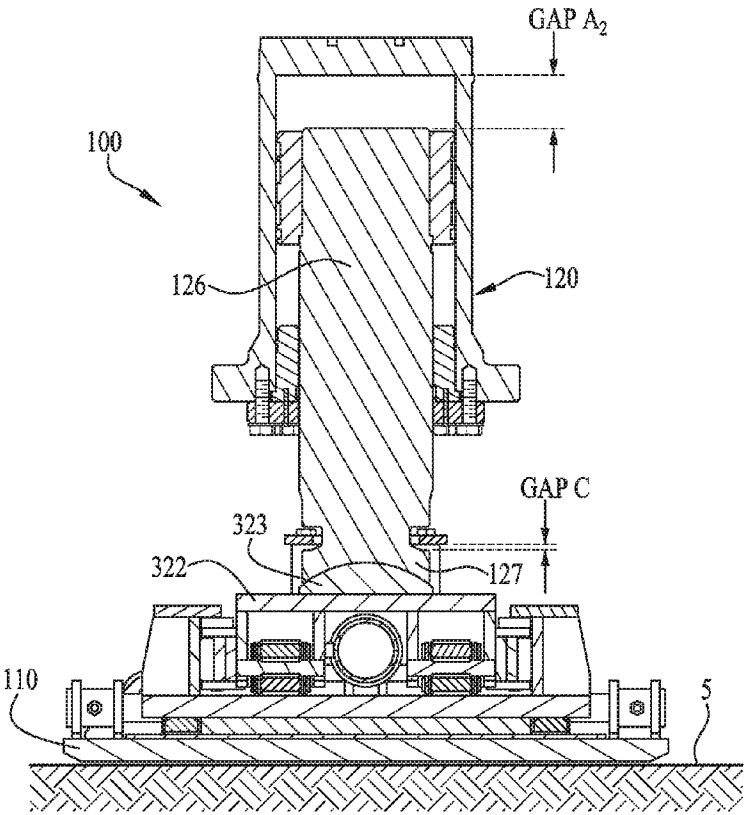

FIG. 40 illustrates the walking machine unit 100 with the lift mechanism 120 in the fully retracted position (with no gap between the piston 126 and the lift cylinder 125), with the foot pad 110 being lifted off the ground by a gap A. The two-part lifting plate 121 is secured by bolts 122, through spacers 123 to the top plate 322 of the roller assembly 305. The bottom face of the piston cylinder 126 comprises a spherical concave surface 129 (see also FIG. 34) for engaging the corresponding convex dome surface of the dome plate 323. The piston cylinder 126 (and its concave bottom surface) is separated by a gap B from the dome plate 323 of the lifting plate 121, and the shoulder 127 of the piston 126 is in contact with the lifting plate 121. As the piston 126 is retracted, the shoulder 127 comes in contact with the lifting plate 121 to lift the foot section 110 off the ground surface 5. There is a gap B between the piston 126 and the dome plate 323 when retracting/lifting the foot section 110 as shown.

Figure 41:
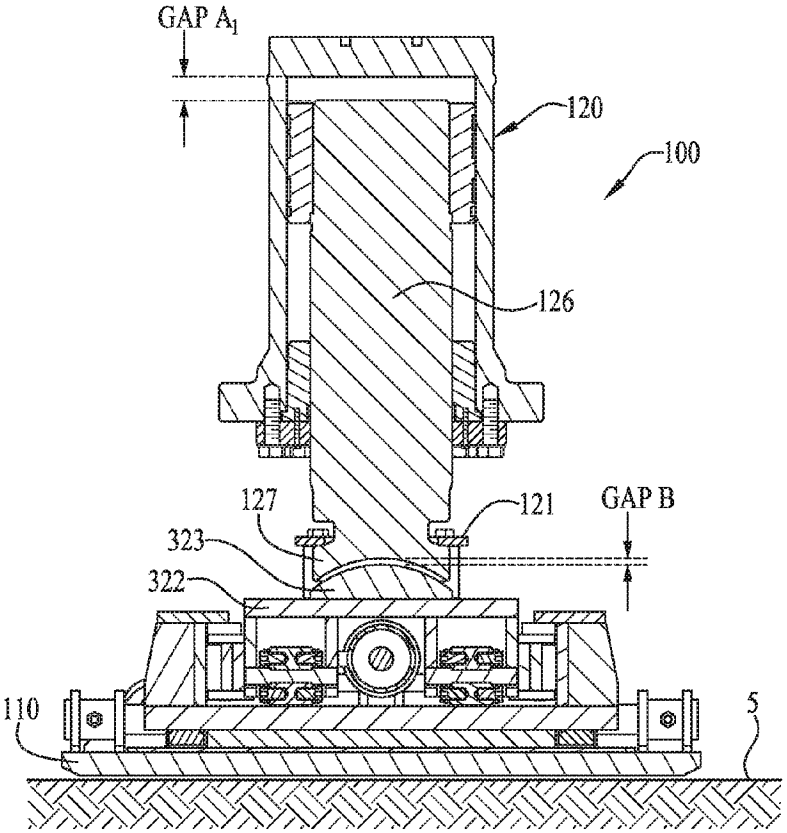
FIG. 41 is a partial cross-sectional view of the walking unit of FIG. 14 illustrating a lifting device with the lift mechanism in a first partially extended position, with the foot pad in contact with the ground.

FIG. 41 illustrates the walking machine unit 100 with the lift mechanism 120 in a first partially extended position (with a gap $A_1$ between the piston 126 and the lift cylinder 125), with the foot plate 111 just touching the ground surface 5. There is still the gap B between the piston 126 and the dome plate 323 when retracting/lifting the foot section 110 is in the position as shown.

FIG. 42 is illustrates the walking machine unit 100 with the lift mechanism 120 in a second partially extended position (with a gap $A_2$ between the piston 126 and the lift cylinder 125), with no gap between the piston 126 and the dome plate 323, but there is a gap C between the lifting plate 121 and the shoulder 127.

FIG. 43 illustrates the walking machine unit 100 with the lift mechanism 120 in a fully extended position with a gap $A_3$ between the piston 126 and the lift cylinder 125 and with the load lifted off the ground surface 5. As in FIG. 42, there is no gap between the piston 126 and the dome plate 323, but there is a gap C between the lifting plate 121 and the shoulder 127.

Other embodiments are envisioned. Although the description above contains certain specific details, these details should not be construed as limiting the scope of the invention, but as merely providing illustrations of some embodiments/examples. It should be understood that subject matter disclosed in one portion herein can be combined with the subject matter of one or more of other portions herein as long as such combinations are not mutually exclusive or inoperable.

The terms and descriptions used herein are set forth by way of illustration only and not meant as limitations. It will be obvious to those having skill in the art that many changes may be made to the details of the above-described embodiments without departing from the underlying principles of the invention.

The invention claimed is:

1. A walking machine system configured to move a load over a road or other ground surface in one or more incremental steps via a plurality of lift/transport assemblies, each lift/transport assembly comprising:

- a lift mechanism operative to lift a load-bearing frame supporting the load;
- a foot pad assembly for contacting the road or other ground surface;
- a translation assembly coupled to the lift mechanism and the foot pad, the translation assembly comprising:
  - a longitudinal drive assembly supporting the lift mechanism and operative for translating the lifting mechanism and the load along a longitudinal direction, and
  - a lateral drive assembly supporting the longitudinal drive assembly and operative for translating, independently of the longitudinal drive assembly, the longitudinal drive assembly, the lifting mechanism and the load along a lateral direction;
- a slide plate disposed on a top surface of the foot pad assembly, wherein the longitudinal drive assembly includes a roller assembly, a track housing for supporting the roller assembly and a longitudinal drive cylinder system for moving the roller assembly longitudinally along the track housing; and
- a lateral drive system for moving the track housing laterally in a sliding motion across the slide plate.

2. A system according to claim 1 wherein the slide plate is disposed flat on a central portion of the foot plate nesting between retaining elements connected to the slide plate in a free-floating condition flat against the foot plate.

3. A system according to claim 2 wherein the slide plate is attached to the foot plate.

4. A system according to claim 1 wherein the lateral drive assembly comprises a low friction or reduced friction surface or plate between the foot pad assembly and a bottom surface of the longitudinal drive assembly, wherein the low friction or reduced friction plate comprises a flat bushing.

5. A system according to claim 1 wherein the lateral drive assembly comprises a low friction or reduced friction surface or plate between the foot pad assembly and a bottom surface of the longitudinal drive assembly, wherein the low friction or reduced friction plate is constructed of a nylon sheet.

6. A system according to claim 1 wherein the lateral drive assembly comprises a low friction or reduced friction surface or plate between the foot pad assembly and a bottom surface of the longitudinal drive assembly, wherein the lateral drive assembly comprises a hydraulic piston and cylinder drive system.

7. A system according to claim 1 wherein the lateral drive assembly comprises a low friction or reduced friction surface or plate between the foot pad assembly and a bottom surface of the longitudinal drive assembly, wherein the lateral drive assembly comprises a drive system selected from the group consisting of: hydraulic piston and cylinder drive, jack screw drive, rack and pinion assembly, chain and sprocket drive, gear drive, electric motor drive.

8. A walking machine system configured to move a load over a road or other ground surface in one or more incremental steps via a plurality of lift/transport assemblies, each lift/transport assembly comprising:

a lift mechanism operative to lift a load-bearing frame supporting the load;

a foot pad assembly for contacting the road or other ground surface;

a translation assembly coupled to the lift mechanism and the foot pad, the translation assembly comprising:

a longitudinal drive assembly supporting the lift mechanism and operative for translating the lifting mechanism and the load along a longitudinal direction, and a lateral drive assembly supporting the longitudinal drive assembly and operative for translating independently of the longitudinal drive assembly, the longitudinal drive assembly, the lifting mechanism and the load along a lateral direction;

wherein the longitudinal drive assembly includes a first roller assembly, a track housing for supporting the roller assembly and a longitudinal drive cylinder system for moving the first roller assembly longitudinally along the track housing;

wherein the lateral drive assembly comprises a second roller assembly between the foot pad and a bottom surface of the track housing, and a lateral drive cylinder system for moving the track housing laterally across the foot pad using the second roller assembly.

9. A system according to claim 8 wherein the longitudinal drive assembly and the lateral drive assembly are operative for simultaneous operation for translating the lifting mechanism and the load along a diagonal direction.

10. A system according to claim 8 wherein the lateral drive assembly comprises a roller assembly between the foot pad assembly and a bottom surface of the longitudinal drive assembly, and a lateral drive system for moving the longitudinal drive assembly laterally across the foot pad assembly using the roller assembly.

11. A system according to claim 8 wherein the longitudinal drive assembly comprises a longitudinal drive system selected from the group consisting of: hydraulic piston and cylinder drive, jack screw drive, rack and pinion assembly, chain and sprocket drive, gear drive, electric motor drive.

12. A method for steering a load transportation system configured to move a load over a surface in one or more incremental steps via a plurality of lift/transport assemblies, each lift/transport assembly comprising a lift mechanism operative to lift a load-bearing frame supporting the load, a rolling assembly, including a foot pad for contacting the surface, the rolling assembly rotatably coupled to the lift mechanism, the method comprising the steps of via a longitudinal drive assembly operative for supporting the lift mechanism, translating the lifting mechanism and the load along a longitudinal direction, the longitudinal drive assembly comprising a track housing for supporting the roller assembly and a longitudinal drive cylinder system for moving the roller assembly longitudinally along the track housing, and via a lateral drive assembly, translating the longitudinal drive assembly, the lifting mechanism and the load along a lateral direction independently of longitudinal translation provided by the longitudinal drive assembly.

13. A method according to claim 12 further comprising translating the load in a diagonal direction by simultaneously actuating the longitudinal drive assembly and the lateral drive assembly.

* * * * *